US008162710B2

(12) United States Patent
Okumura

(10) Patent No.: US 8,162,710 B2
(45) Date of Patent: Apr. 24, 2012

(54) METHOD FOR PRODUCING PLASMA DISPLAY PANEL WITH A BRIGHT DISPLAY AND A LOW OPERATING VOLTAGE

(75) Inventor: Tomohiro Okumura, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/868,786

(22) Filed: Aug. 26, 2010

(65) Prior Publication Data

US 2011/0048631 A1 Mar. 3, 2011

(30) Foreign Application Priority Data

Aug. 26, 2009 (JP) ..... P2009-195726

(51) Int. Cl.
*H01J 9/00* (2006.01)

(52) U.S. Cl. ..... 445/25

(58) Field of Classification Search ..... 445/49–51; 313/582–587

See application file for complete search history.

(56) References Cited

U.S. PATENT DOCUMENTS

| | | | |
|---|---|---|---|
| 2002/0121861 | A1 | 9/2002 | Katou et al. |
| 2007/0013306 | A1 | 1/2007 | Hai et al. |
| 2011/0001427 | A1 | 1/2011 | Betsui et al. |

FOREIGN PATENT DOCUMENTS

| | | |
|---|---|---|
| EP | 0 881 657 | 12/1998 |
| JP | 8-236028 | 9/1996 |
| JP | 10-334809 | 12/1998 |
| JP | 10-334812 | 12/1998 |
| JP | 11-339665 | 12/1999 |
| JP | 2002-75173 | 3/2002 |
| JP | 2002-260535 | 9/2002 |
| JP | 2006-59779 | 3/2006 |
| WO | 2009/044456 | 4/2009 |

*Primary Examiner* — Joseph L Williams

(74) *Attorney, Agent, or Firm* — Wenderoth, Lind & Ponack, L.L.P.

(57) ABSTRACT

A method for producing a plasma display panel, the method including preparing a front panel and a rear panel, the front panel being a panel wherein a first electrode, a first dielectric layer and a protective layer are formed on a first substrate, and the rear panel being a panel wherein a second electrode, a second dielectric layer, a partition wall and a phosphor layer are formed on a second substrate; and opposing the front and rear panels with each other, and sealing the front and rear panels along their peripheries by a sealing material wherein the protective layer is heated to a temperature ranging from 1600° C. to 3600° C. before the sealing of the front and rear panels.

9 Claims, 16 Drawing Sheets

(i) Gas desorption characteristic ($H_2O$) of protective layer after being subjected to heat treatment at 1550℃

(ii) Gas desorption characteristic ($CO_2$) of protective layer after being subjected to heat treatment at 1550℃

(i) Gas desorption characteristic ($H_2O$) of protective layer after being subjected to heat treatment at 2000℃

(ii) Gas desorption characteristic ($CO_2$) of protective layer after being subjected to heat treatment at 2000℃

Heat treatment temperature: 2800℃

Heat treatment temperature: 3700℃

METHOD FOR PRODUCING PLASMA DISPLAY PANEL WITH A BRIGHT DISPLAY AND A LOW OPERATING VOLTAGE

FIELD OF THE INVENTION

The present invention relates to a method for producing a plasma display panel which can be used for image display of televisions and computers.

BACKGROUND OF THE INVENTION

A plasma display panel (hereinafter also referred to as "PDP") has the capabilities of high definition reproduction of pictures and a larger screen, and thus has been commercialized as 100-inch class television sets. In recent years, it has been attempted to apply the PDP to high definition television sets with twice or more scan lines as those of the conventional NTSC TV format. Furthermore, there have been increasing requirements for the PDP to have decreased power consumption for addressing the energy issue and to have lead-free material for meeting environmental requirements.

The PDP is basically composed of a front panel and a rear panel. The front panel is disposed at the front such that it faces the viewer. Such front panel is generally provided with a glass substrate, display electrodes (each of which comprises a transparent electrode and a bus electrode), a dielectric layer and a protective layer. Specifically, (i) on one of the principal surfaces of the glass substrate (e.g. sodium borosilicate glass substrate), the display electrodes are formed in the form of stripes; (ii) the dielectric layer is formed on the principal surface of the glass substrate so as to cover the display electrodes and to serve as a capacitor; and (iii) the protective layer (e.g. MgO layer) is formed on the dielectric layer so as to protect the dielectric layer.

The rear panel is generally provided with a glass substrate, address electrodes, a dielectric layer, partition walls and phosphor layers (i.e. red(R), green(G) and blue(B) fluorescent layers). Specifically, (i) on one of principal surfaces of the glass substrate, the address electrodes are formed in the form of stripes; (ii) the dielectric layer is formed as a base dielectric layer on the principal surface of the glass substrate so as to cover the address electrodes; (iii) a plurality of partition walls (i.e. barrier ribs) are formed on the dielectric layer at equal intervals; and (iv) the phosphor layers are formed on the dielectric layer such that each phosphor layer is located between the adjacent partition walls.

The front panel and the rear panel are opposed to each other so that their electrodes face each other. The opposed front and rear panels are sealed together to form an airtight discharge space that is divided by the partition walls. The discharge space is filled with a discharge gas such as neon (Ne)-xenon (Xe) gas. In operation of the PDP, ultraviolet rays are generated in the discharge cell upon selectively applying a voltage (i.e. voltage of picture signal), and thereby the phosphor layers capable of emitting different visible lights are excited. As a result, the excited phosphor layers respectively emit lights in red, green and blue colors, which will lead to an achievement of a full-color display.

The PDP is ordinarily operated by such a method that sets an initialization period during which charges on the wall are adjusted into a state that allows easy writing, a writing period during which writing electric discharge is carried out in accordance to the input picture signal, and a sustain period during which the pictures are displayed by causing sustain electric discharge in the discharge space wherein the writing operation has been done. Thus, the PDP displays gradation pictures by repeating a period (sub-field) that consists of the periods described above a plurality of times within a period (one field) that corresponds to one frame of picture.

In the PDP, the protective layer of the front panel generally serves to protect the dielectric layer from ion bombardment caused by electric discharge and also serves to release primary electrons for generating an address electric discharge. The protecting of the dielectric layer from ion bombardment is important in terms of preventing the discharge voltage from rising. Whereas, the releasing of the primary electrons for generating the address electric discharge is important in terms of preventing the discharge failure that may cause a blinking of the picture.

There are some attempts to increase the number of primary electrons released from the protective layer, and thereby suppressing the blinking of the picture. For example, some impurity is added to the MgO protective layer, or MgO particles are formed on the MgO protective layer. See Japanese Patent Kokai Publication No. 2002-260535, Japanese Patent Kokai Publication No. 11-339665, Japanese Patent Kokai Publication No. 2006-59779, Japanese Patent Kokai Publication No. 8-236028 and Japanese Patent Kokai Publication No. 10-334809 for example.

The operating voltage of the PDP depends on a secondary electron emission coefficient of the protective layer. Accordingly, it has been proposed to use, as a raw material of the protective layer, an oxide of alkaline earth metal (e.g. calcium oxide, strontium oxide and barium oxide) with lower value of work function than that of magnesium oxide, and thereby decreasing of in an attempt to decrease the operating voltage. However, the oxides of alkaline earth metals have high hygroscopic property, and thus the protective layer made of such oxides tends to absorb the moisture of the atmosphere, and thereby the oxides of the protective layer turn into hydroxide. This results in the instability of the electric discharge. Also the oxides of these alkaline earth metals have tendency to turn into carbonated matter, making it difficult to decrease the operating voltage.

Under the above circumstances, the present invention has been created. Thus, an object of the present invention is to provide a desirable method for producing a PDP in terms of "electric discharge characteristic" and "lower operating voltage".

SUMMARY OF THE INVENTION

In order to achieve the above object, the present invention provides a method for producing a plasma display panel, the method comprising:

(i) preparing a front panel and a rear panel, the front panel being a panel wherein an electrode A, a dielectric layer A and a protective layer are formed on a substrate A, and the rear panel being a panel wherein an electrode B, a dielectric layer B, a partition wall and a phosphor layer are formed on a substrate B; and (ii) opposing the front and rear panels with each other, and sealing them along their peripheries by a sealing material wherein the protective layer is heated to a temperature ranging from 1600° C. to 3600° C. after the preparation of the front panel and before the sealing of the front and rear panels.

For one thing, the method of the present invention is characterized in that the protective layer of the front panel is heated to a temperature in a range from 1600° C. to 3600° C. at a certain point in time after the preparation of the front panel and before the sealing of the front and rear panels (see FIG. 1), such temperature being a very high temperature which is not employed in the conventional PDP producing process. Such heating of the protective layer makes it possible to remove impurities (e.g. $H_2O$ and $CO_2$) from the protective layer. Furthermore, due to the heating of the protective layer, the protective layer after being heated is suppressed from reacting with the impurities (such as $H_2O$ and $CO_2$).

In this specification, the term "sealing" refers to a so-called "panel sealing". Thus, term "sealing" substantially means a sealing treatment in which the front and rear panels are opposed to each other and then they are sealed along their peripheries with a sealing material (e.g. glass frit). In this regard, according to the present invention, the protective layer of the front panel is subjected to a heat treatment prior to the sealing treatment. The term "peripheries" used in the sealing step (ii) substantially refers to the respective areas of the front and rear panels whereon the sealing material is applied or supplied upon a typical production of the PDP.

In one preferred embodiment, the protective layer is heated by irradiating the surface thereof with a thermal plasma. In other words, the thermal plasma is supplied onto the surface of the protective layer. The thermal plasma irradiation is preferably performed by using a thermal plasma torch. The protective layer can be entirely heated with a time lag by scanning the thermal plasma torch upon the thermal plasma irradiation. The thermal plasma heating enables it to heat the protective layer without melting the substrate A of the front panel. In a case where the substrate A is a glass substrate for example, the protective layer can be heated in a temperature range of from 1600° C. to 3600° C. while preventing the melting of the glass substrate.

It is preferred in the method of the present invention that the protective layer is heated while being exposed to an inert gas. That is, in the case of the thermal plasma heating, the protective layer is irradiated with the thermal plasma while supplying the inert gas to the surface of the protective layer.

In a case where a thermal plasma torch is used, it is preferable to generate a thermal plasma from the torch, while supplying an inert gas to the torch, by applying a voltage across a center electrode and a surrounding electrode disposed in concentric configuration. The operating conditions and specifications for the thermal plasma torch may be as follows:

Scanning speed of torch: The thermal plasma torch and the front panel are moved relative to each other at a velocity of about 100 mm/s to about 5000 mm/s.

Scanning pitch of torch: The scanning pitch of the thermal plasma torch is smaller than the inner diameter of a nozzle of the thermal plasma torch (i.e. inner diameter of the surrounding electrode's hole to be oppositely arranged with respect to the substrate).

It is preferred in the method of the present invention that the protective layer after being heated is cooled down. In this case, it is preferable to cool down the protective layer after being heated is cooled down to 100° C. or lower by means of an inert gas. It is more preferable to cool down the protective layer after being heated is cooled down to 100° C. or lower in an inert gas atmosphere. For example, when the heating operation is carried out in a vessel filled with an inert gas, the heated protective layer is cooled down to 100° C. or lower by such filled inert gas. In a case where the thermal plasma torch is used, the heated protective layer can be cooled down to 100° C. or lower by blowing the inert gas to a heated portion of the protective layer surface, such portion having been heated by the torch.

In one preferred embodiment of the present invention, the protective layer to be heated is made from a metal oxide comprising at least two oxides selected from among magnesium oxide, calcium oxide, strontium oxide and barium oxide, said metal oxide having a peak between the minimum diffraction angle and the maximum diffraction angle which are selected among the diffraction angles given by respective ones of said at least two oxides in a specific orientation plane in X-ray diffraction analysis. In other words, the protective layer can be made by using of favorable components in terms of electric discharge characteristic and lower operating voltage.

The method of the present invention enables it not only to remove impurities of the protective layer (e.g. $H_2O$ and $CO_2$) therefrom, but also thereafter to suppress the protective layer and the impurity (e.g. $H_2O$ and $CO_2$) from reacting with each other. Therefore, in accordance with the method of the present invention, a desired component of the protective layer (e.g. oxide of alkaline earth element) can be positively used, such component tending to absorb or adsorb impurities, but being favorable in terms of electric discharge characteristic and lower operating voltage.

More specifically, the method of the present invention enables it to use at least one kind of metal oxide selected from among magnesium oxide, calcium oxide, strontium oxide and barium oxide as the component of the protective layer. In particular, it is possible to use the metal oxide consisting of at least two oxides selected from among magnesium oxide, calcium oxide, strontium oxide and barium oxide, said metal oxide having a peak diffraction angle between the minimum diffraction angle and the maximum diffraction angle which are selected among the diffraction angles given by respective ones of said at least two oxides constituting the metal oxide with respect to a specific orientation plane in X-ray diffraction analysis. Use of such component in the protective layer can lower the electric discharge starting voltage of the panel, and decrease the delay of the electric discharge, thereby providing a particularly significant effect in terms of a stable electric discharge.

The metal oxides described above is highly reactive with impurity gases such as water gas and carbon dioxide gas. In general, the protective layer thus tends to undergo a deterioration of discharge characteristic through the reaction with water and carbon dioxide. However, in this regard, according to the present invention, the impurities (i.e. $H_2O$ and $CO_2$) of the protective layer can be removed from the protective layer, and thereafter the protective layer can be suppressed from reacting with the impurities (i.e. $H_2O$ and $CO_2$ gas). Therefore, such metal oxides can be positively used as the component of the protective layer (Namely, the use of the metal oxide as a component of the protective layer is effectively promoted).

In the PDP obtained by the present invention, the electric discharge starting voltage can be lowered due to the improved secondary electron emission characteristic of the protective layer, and also a delay of the electric discharge can be decreased, which leads to an achievement of a stability of the electric discharge. In other words, in the PDP produced by the method of the present invention, the lowering of the electric discharge starting voltage can be achieved even when a partial pressure of Xe gas is increased in order to improve the brightness of the PDP. Accordingly, the present invention can provides a plasma display panel with a higher brightness of picture display and a lower voltage driving.

DETAILED DESCRIPTION OF THE INVENTION

Figure 1:
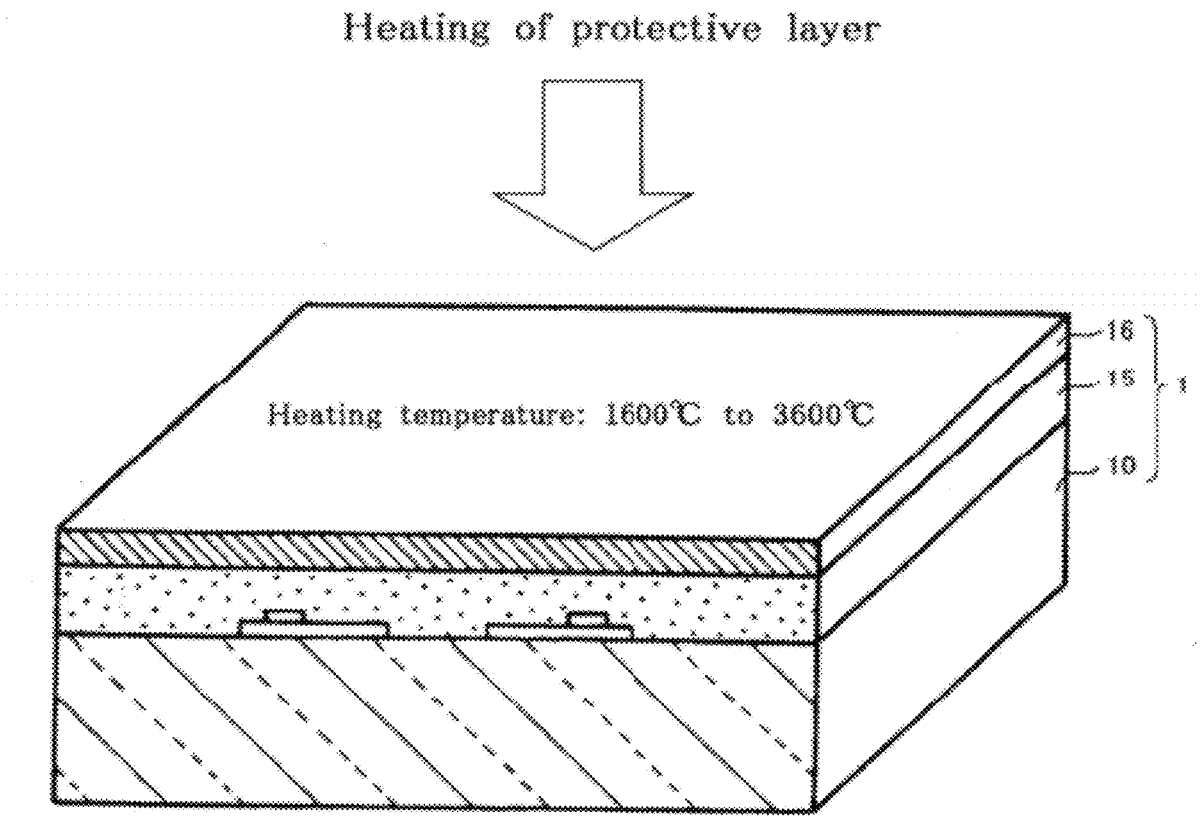
FIG. 1 is a diagram schematically showing a concept of the present invention.

With reference to the accompanying drawings, a method for producing a plasma display panel according to the present invention will be described in detail. Various components or elements are shown schematically in the drawings with dimensional proportions and appearances that are not necessarily real, which are merely for the purpose of making it easy to understand the present invention.

[Construction of Plasma Display Panel]

Figure 2:
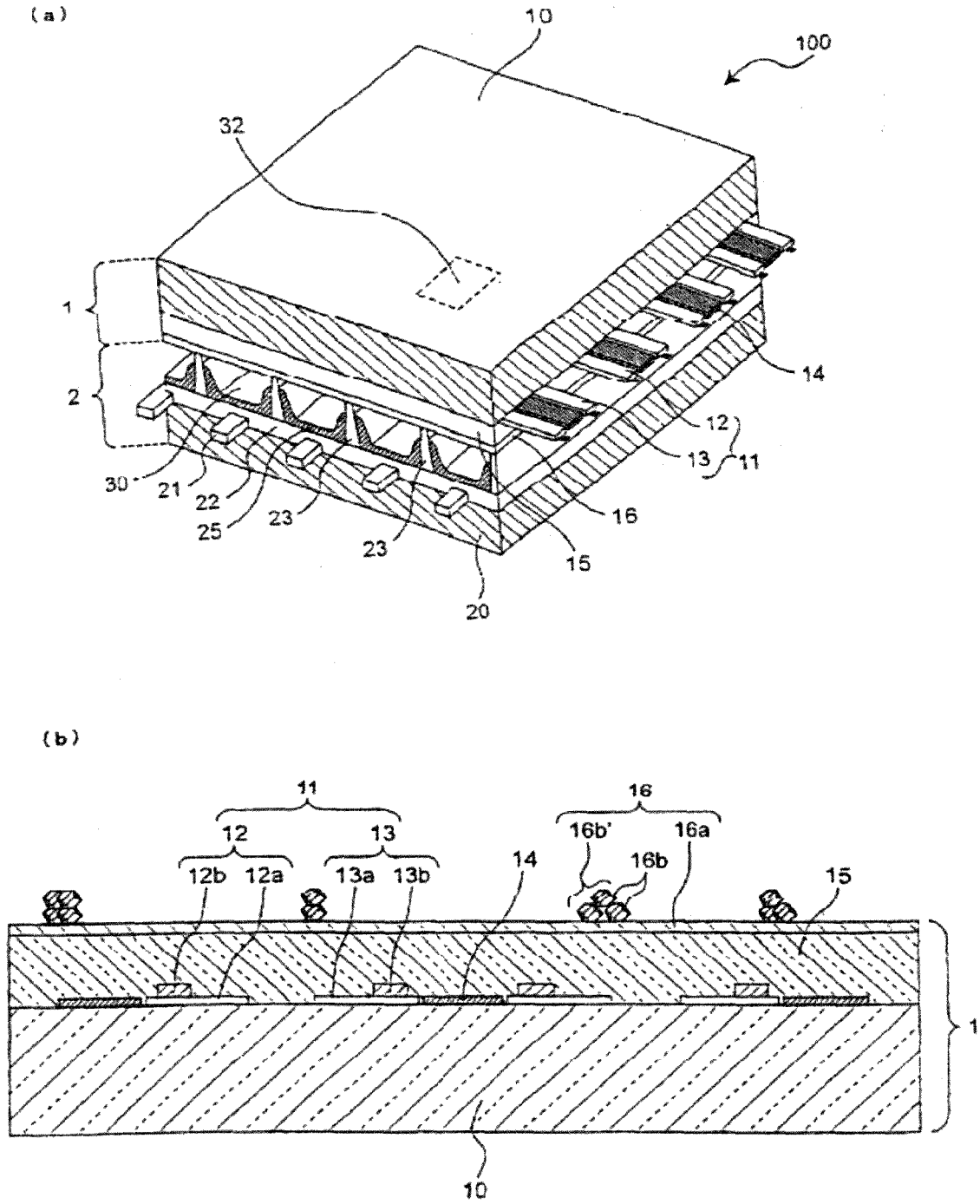
FIG. 2(*a*) is a perspective view schematically showing a structure of PDP, and FIG. 2(*b*) is a sectional view schematically showing a front panel of PDP (particularly, a front panel provided with a protective layer composed of a base film and crystal particles formed thereon).

First, a plasma display panel, which can be finally obtained by the method of the present invention, is described below. FIG. 2(*a*) schematically shows a perspective and sectional view of the construction of PDP. FIG. 2(*b*) schematically shows a sectional view of the front panel of the PDP.

As shown in FIG. 2(*a*), the PDP (100) of the present invention comprises a front panel (1) and a rear panel (2) opposed to each other. The front panel (1) is generally provided with a substrate A (10), electrodes A (11), a dielectric layer A (15) and a protective layer (16). The rear panel (2) is generally provided with a substrate B (20), electrodes B (21), a dielectric layer B (22), partition walls (23) and phosphor layers (25).

As for the front panel (1), (i) on one of principal surfaces of the substrate A (10), the electrodes A (11) are formed in a form of stripes; (ii) the dielectric layer A (15) is formed on the principal surface of the substrate A (10) so as to cover the electrodes A (11); and (iii) the protective layer (16) is formed on the dielectric layer A (15) so as to protect the dielectric layer A (15). As for the rear panel (2), (i) on one of principal surfaces of the substrate B (20), the electrodes B (21) are formed in a form of stripes; (ii) the dielectric layer B (22) is formed on the principal surface of the substrate B (20) so as to cover the electrodes B (21); (iii) a plurality of partition walls (23) are formed on the dielectric layer B (22) at equal intervals; and (iv) the phosphor layers (25) are formed on the dielectric layer B (22) such that each of them is located between the adjacent partition walls (23). As illustrated, the front panel (1) and the rear panel (2) are opposed to each other. The opposed front and rear panels are sealed along their peripheries by a sealing material (not shown). As the sealing material, a material consisting mainly of a glass frit with a low melting point may be used. Between the front panel (1) and the rear panel (2), there is formed a discharge space (30) filled with a discharge gas (helium, neon, xenon or the like) under a pressure preferably from 20 kPa to 80 kPa. The PDP (100) of the present invention will be described below in much more detail. As described above, the front panel (1) of the PDP (100) according to the present invention comprises the substrate A (10), the electrodes A (11), the dielectric layer A (15) and the protective layer (16). The substrate A (10) is a transparent substrate with an electrical insulating property. The thickness of the substrate A (10) may be in the range of from about 1.0 mm to about 3 mm. The substrate A (10) may be a float glass substrate produced by a floating process. The substrate A (10) may also be a soda lime glass substrate or a borosilicate glass substrate. A plurality of electrodes A (11) are formed in a pattern of parallel stripes on the substrate A (10). It is preferred that the electrode A (11) is a display electrode which is composed of a scan electrode (12) and a sustain electrode (13). Each of the scan electrode (12) and the sustain electrode (13) is composed of a transparent electrode (12*a*, 13*a*) and a bus electrode (12*b*, 13*b*). The transparent electrode (12*a*, 13*a*) may be an electrically conductive film made of indium oxide (ITO) or tin oxide ($SnO_2$) in which case the visible light generated from the phosphor layer can go through the film. The bus electrode (12*b*, 13*b*) is formed on the transparent electrode (12*a*, 13*a*), and may be mainly made of silver so that it serves to reduce a resistance of the display electrode and give an electrical conductivity in the longitudinal direction for the transparent electrode. Thickness of the transparent electrodes (12*a*, 13*a*) is preferably in the range of from about 50 nm to about 500 nm whereas thickness of the bus electrodes (12*b*, 13*b*) is preferably in the range of from about 1 μm to about 20 μm. As shown in FIG. 2(*a*), black stripes (14) (i.e. light shielding layer) may also be additionally formed on the substrate A (10).

The dielectric layer A (15) is provided to cover the electrodes A (11) on the surface of the substrate A (10). The dielectric layer A (15) may be a glass film, for example an oxide film (e.g. silicon oxide film). Such oxide film can be formed by applying a dielectric material paste consisting mainly of a glass component and a vehicle component (i.e. component including a binder resin and an organic solvent), followed by heating the dielectric material paste. On the dielectric layer A (15), there is formed the protective layer (16) whose thickness is for example from about 0.5 μm to about 1.5 μm. The protective layer (16) may be made of magnesium oxide (MgO), and serves to protect the dielectric layer A (15) from a discharge impact (more specifically, from the impact of ion bombardment attributable to the plasma).

As described above, the rear panel (2) of the PDP according to the present invention comprises the substrate B (20), the electrodes B (21), the dielectric layer B (22), the partition walls (23) and the phosphor layers (25). The substrate B (20) is preferably a transparent substrate with an electrical insulating property. The thickness of the substrate B (20) may be in the range of from about 1.0 mm to about 3 mm. The substrate B (20) may be a float glass substrate produced by a floating process. The substrate B (20) may also be a soda lime glass substrate or a borosilicate glass substrate. Furthermore, the substrate B (20) may also be a substrate made of various ceramic materials. A plurality of the electrodes B (21) is formed in a pattern of parallel stripes on the substrate B (20). For example, the electrode B (21) is an address electrode or a data electrode (whose thickness is for example about 1 μm to about 10 μm). The electrodes B (21) serve to cause the discharge to occur selectively in particular discharge cells. The electrodes B (21) can be formed from an electrically conductive paste including silver as a main component.

The dielectric layer B (22) is provided to cover the electrodes B (21) on the surface of the substrate B (20). The dielectric layer B (22) is generally referred to as a base dielectric layer. The dielectric layer B (22) may be a glass film, for example an oxide film (e.g. silicon oxide film). Such oxide film can be formed by applying a dielectric material paste consisting mainly of a glass component and a vehicle component (i.e. component including a binder resin and an organic solvent), followed by heating the dielectric material paste. Thickness of the dielectric layer B (22) is preferably in the range of from about 5 μm to about 50 μm. On the dielectric layer B (22), there is formed the phosphor layers (25) whose thickness is for example from about 5 μm to about 20 μm. The phosphor layers (25) serve to convert the ultraviolet ray emitted due to the discharge into visual light ray. The three kinds of the phosphor layer constitute a basic unit wherein three kind of fluorescent material layers, each of which is separated from each other by the partition walls (23), are respectively capable of emitting red, green and blue lights. The partition walls (23) are provided in a form of stripes or in two pairs of perpendicularly intersecting parallel lines on the dielectric layer B (22). The partition walls (23) serve to divide the discharge space into cells, each of which is allocated to one of the address electrodes (21). The partition walls (23) can be made from a paste containing of a glass power, a vehicle component, a filler, etc.

In the PDP (100), the front panel (1) and the rear panel (2) are opposed to each other such that the display electrode (11) of the front panel (1) and the address electrode (21) of the rear panel (2) perpendicularly intersect with each other. Between the front panel (1) and the rear panel (2), there is formed a discharge space (30) filled with a discharge gas. With such a construction of the PDP (100), the discharge space (30) is divided by the partition walls. Each of the divided discharge space (30), at which the display electrode (11) and the address electrode (21) intersect with each other, serves as a discharge cell (32). The discharge cells (32) arranged in a matrix form give an image display region. The discharge gas is caused to discharge by applying a picture signal voltage selectively to the display electrodes from an external drive circuit. The ultraviolet ray generated due to the discharge of the discharge gas can excite the phosphor layers so as to emit visible lights of red, green and blue colors therefrom, which will lead to an achievement of a display of color images or pictures.

[General Method for Production of PDP]

Next, a typical production of the PDP will be briefly described. In this specification, unless otherwise mentioned, raw materials (i.e. paste material) of the constituent members or parts may be the same as those used in the conventional PDP production.

The typical production of the PDP (100) comprises a step for forming the front panel (1) and a step for forming the rear panel (2). As for the step for forming the front panel (1), not only the display electrode (11) composed of the scan electrode (12) and the sustain electrode (13) but also and the light shielding layer (14) is firstly formed on the glass substrate A (10). In the forming of each of the scan electrode (12) and the sustain electrode (13), a transparent electrode (12*a*, 13*a*) and a bus electrode (12*b*, 13*b*) can be formed through a patterning process such as a photolithography wherein an exposure and a developing are carried out. The transparent electrode (12*a*, 13*a*) can be formed by a thin film process. The bus electrode (12*b*, 13*b*) can be formed by drying a silver (Ag)-containing paste at a temperature of about 100 to 200° C., followed by a calcining treatment thereof at a temperature of about 400 to 600° C. The light shielding layer (14) can also be formed in a similar way. Specifically, a light shielding layer precursor can be formed in a desired form by a screen printing process wherein a black pigment-containing paste is printed, or by a photolithography process wherein a black pigment-containing paste is applied over the substrate followed by exposure and developing thereof. The resulting light shielding layer precursor is finally calcined to form the light shielding layer therefrom. After the formation of the display electrode (11) and the light shielding layer (14), the dielectric layer A (15) is formed. Specifically, a layer of dielectric material paste is firstly formed on the substrate A (10) so as to cover the scan electrodes (12), sustain electrodes (13) and the light shielding layer (14). This formation of the paste layer can be performed by applying a paste of dielectric material consisting mainly of a glass component (a material including $SiO_2$, $B_2O_3$, etc.) and a vehicle component with a die coating or printing process. The dielectric material paste that has been applied is left to stand for a predetermined period of time, so that the surface of the dielectric material paste becomes flat. Then the layer of dielectric material paste is calcined to form the dielectric layer A (15) therefrom. After the formation of the dielectric layer A (15), the protective layer (16) is formed on the dielectric layer A (15). In a general sense, the protective layer (16) can be formed by a vacuum deposition process, a CVD process, a sputtering process or the like.

By performing the above steps or operations as described above, the front panel (1) of the PDP can be finally obtained wherein the electrodes A (the scan electrodes (12) and the sustain electrodes (13)), the dielectric layer A (15) and the protective layer (16) are formed on the substrate A (10).

The rear panel (2) is produced as follows. First, a precursor layer for address electrode is formed by screen printing a silver(Ag)-containing paste onto a substrate B (20) (i.e. glass substrate). Alternatively, the precursor layer can be formed by a photolithography process in which a metal film consisting of silver as a main component is formed over the entire surface of the substrate and is subjected to an exposure and development treatments. The resulting precursor layer is then calcined at a predetermined temperature (for example, about 400° C. to about 600° C.), and thereby the address electrodes (21) are formed. The address electrodes (21) may be formed by applying a photoresist onto a 3-layered thin film of chromium/copper/chromium, followed by pattering it with a photolithography and wet etching process. Subsequent to the formation of the electrodes (21), a dielectric layer B (22) (i.e. so-called "base dielectric layer") is formed over the substrate B (20) so as to cover the address electrodes (21). To this end, a dielectric material paste that mainly contains a glass component (e.g. a glass material made of $SiO_2$, $B_2O_3$, or the like) and a vehicle component is applied by a die coating process or the like, so that a dielectric paste layer is formed. The resulting dielectric paste layer is then calcined to form the dielectric layer B (22) therefrom. Subsequently, the partition walls (23) are formed at a predetermined pitch. To this end, a material paste for partition wall is applied onto the dielectric layer B (22) and then patterned in a predetermined form to obtain a partition wall material layer. The partition wall material layer is then heated to form the partition walls therefrom. Specifically, a material paste containing a low melting point glass material, a vehicle component, filler and the like as the main components is applied by a die-coating process or a screen printing process, and then the applied material paste is dried at a temperature of from about 100° C. to 200° C. The dried material is subsequently patterned in a predetermined form by performance of a photolithography process wherein an exposure and a development thereof are carried out. The resulting patterned material is subsequently calcined at a temperature of from about 400° C. to 600° C., and thereby the partition walls are formed therefrom. Alternatively, the partition walls (23) can also be formed a sand blast process, etching process, casting process or the like. After the formation of the partition walls (23), the phosphor layer (25) is formed. To this end, a phosphor material paste is applied onto the dielectric layer (22) provided between the adjacent partition walls (23), and subsequently the applied phosphor material paste is calcined. Specifically, the phosphor layer (25) is formed by applying a material paste containing a fluorescent powder, a vehicle component and the like as the main components by performance of a die coating, printing, dispensing or ink-jet process, followed by drying the applied paste at a temperature of about 100° C. By performing the above steps or operations as described above, the rear panel (2) of the PDP can be finally obtained wherein the electrodes B (the address electrodes (21)), the dielectric layer B (22), the partition walls (23) and the phosphor layer (25) as constituent members are formed on the substrate B (20).

The front panel (1) and the rear panel (2), each being provided with the predetermined constituent members, are disposed to oppose each other such that the display electrode (11) and the address electrode (21) perpendicularly intersect with each other. The front panel (1) and the rear panel (2) are then sealed with each other along their peripheries by the glass frit. After sealing, the space between the front panel (1) and the rear panel (2) is evacuated. After completion of the evacuation, the discharge space (30) between the front panel (1) and the rear panel (2) is then filled with a discharge gas (e.g. helium, neon or xenon) under a pressure of 20 kPa to 80 kPa, resulting in a completion of the production of PDP (100).

[Method of the Present Invention]

The present invention is characterized by the process up to the panel sealing following the formation of the front and rear panels, among the above production steps or operations of the PDP. Firstly, the characterizing portions of the present invention will be described below, and then the protective layer component that can be preferably available due to the present invention will be described.

In the method of the present invention, the protective layer is heated to a temperature ranging from 1600° C. to 3600° C. after the preparing of the front panel and before the sealing of the front and rear panels. More preferably, the protective layer is heated to a temperature ranging from 2000° C. to 3600° C. As a result, the removal of the impurities (e.g. $H_2O$ and $CO_2$) from the protective layer is achieved, and also a subsequent suppression of the protective layer from reacting with the impurities (e.g. $H_2O$ and $CO_2$) is achieved.

Figure 3:
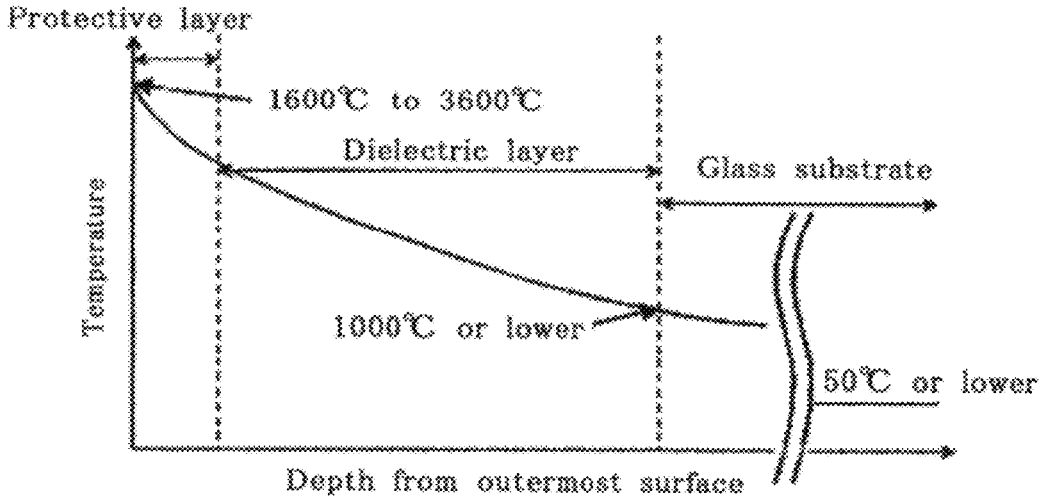
FIG. 3 is a graph schematically showing a temperature gradient of a front panel during heating of a protective layer.

The heating of the protective layer may be performed under an atmospheric pressure condition. It is preferred that the protective layer is heated by performance of a rapid thermal annealing (RTA) using a plasma, a laser or a flash lamp as a heat source. This enables it to effectively subject only the protective layer to the heat treatment without melting the underlying dielectric layer and substrate A (e.g. glass substrate). Specifically, a thermally non-equilibrium is provided in the front panel so that such a temperature gradient as shown in FIG. 3 is formed.

Figure 4:
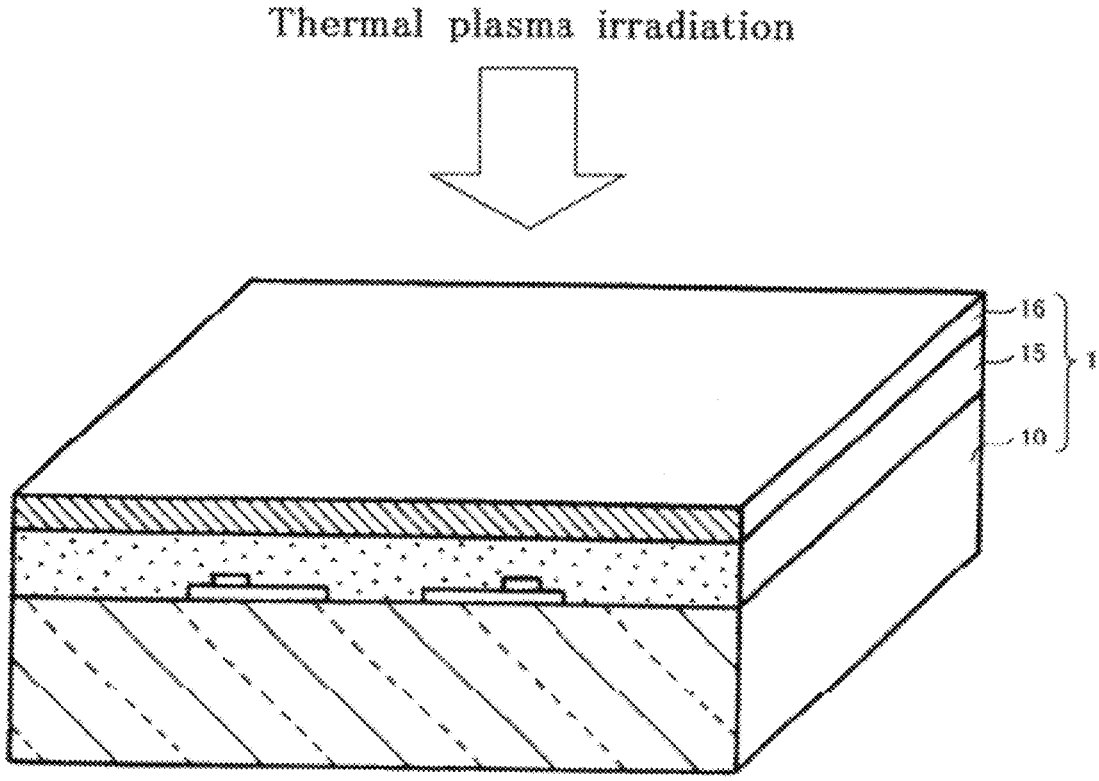
FIG. 4 is a diagram schematically showing a concept of the present invention when irradiation with thermal plasma is performed.

According to the present invention, the surface of the protective layer (16) may be irradiated with thermal plasma as shown in FIG. 4. The phrase "thermal plasma" used herein refers to a plasma generated due to an electric discharge. The plasma may be either "DC plasma generated by DC arc discharge" or "radio-frequency plasma generated by induction heating". In other words, the thermal plasma heating of the protective layer may be performed in any form as long as it utilizes a heat obtained via a plasma energy from an electric energy.

The phrase "protective layer is heated to a temperature ranging from 1600° C. to 3600° C." used in claims and specification substantially means that the heating of the protective layer is performed so that an expose surface of the protective layer reaches a temperature in a range from 1600° C. to 3600° C. The period of the heating treatment (for example, duration time of the plasma irradiation at a certain point of the protective layer) is preferably in the range of from about 1 ms to about 10 ms.

In a case where the protective layer is irradiated with thermal plasma, it is preferable to use a thermal plasma torch. That is, it is preferable to heat the protective layer to a temperature ranging from 1600° C. to 3600° C. by irradiating it with the plasma generated by a thermal plasma torch. Any type of thermal plasma torch may be used as long as it is used in the ordinary plasma heat treatment or plasma welding treatment. Specifically, a DC plasma torch, an induction-coupled plasma torch or a microwave plasma torch may be used. More specifically, it is possible to use a plasma spraying device manufactured by Nihon Ceratec Co., Ltd., a plasma spraying device manufactured by Nihon Eutectic Ltd., a high-frequency induction thermal plasma generator manufactured by JEOL Ltd. and a plasma spraying device manufactured by Sulzer Metco (Japan) Ltd.

Figure 5:
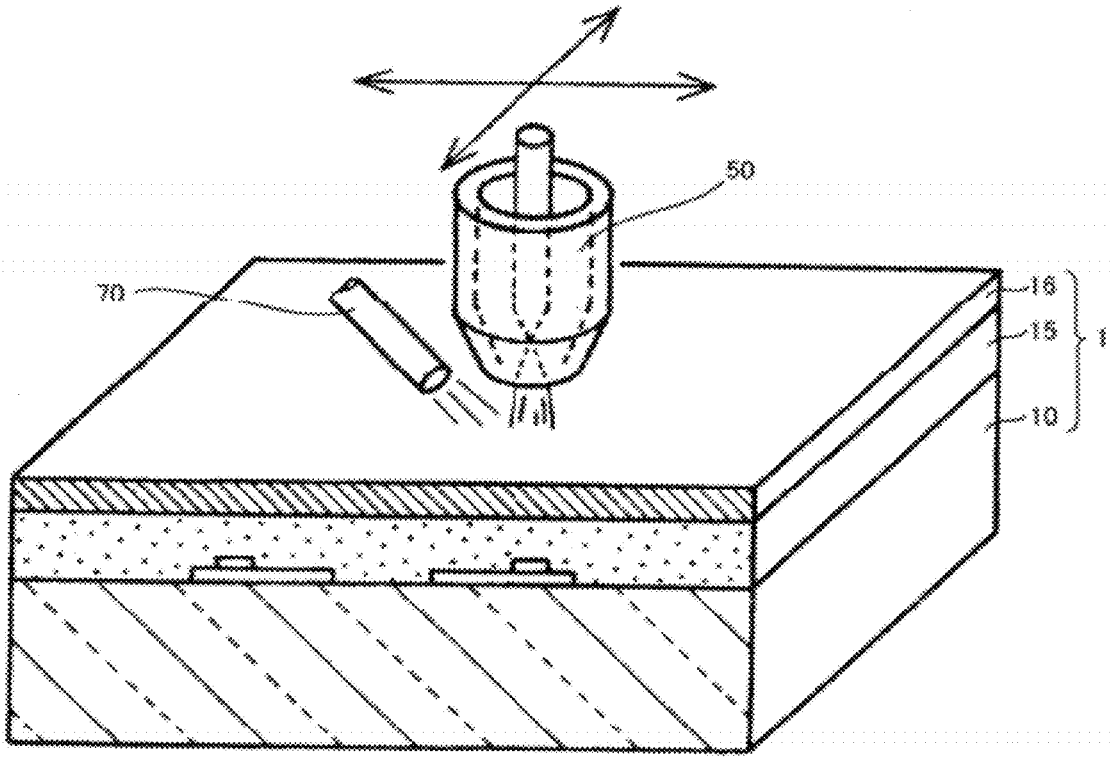
FIG. 5 is a diagram schematically showing a concept of the present invention when a thermal plasma torch is used.
Figure 6:
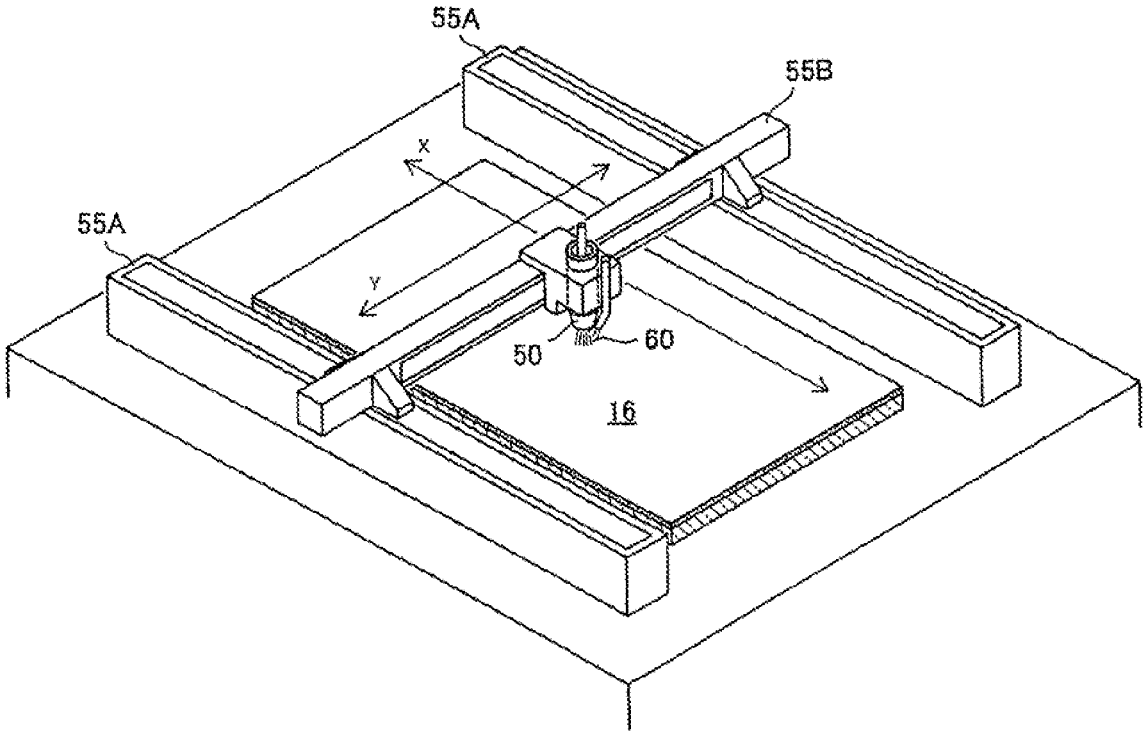
FIG. 6 is a perspective view schematically showing an embodiment wherein a thermal plasma torch equipped with an X-Y drive system is used.

As can be seen from the embodiment shown in FIG. 5, use of the thermal plasma torch enables it to entirely heat the protective layer with a time lag by scanning the thermal plasma torch (50). To scan the torch, it is preferable to use such an X-Y drive system as shown in FIG. 6 since the heat treatment can be effectively applied to the entire protective layer of the PDP. As shown in FIG. 6, the thermal plasma torch (50) is mounted not only movably in X-axis direction along an X-axis guide (55A) but also movably in Y-axis direction along a Y-axis guide (55B). For example, the heat treatment may be applied to the entire protective layer with a time lag by scanning the thermal plasma torch (50) by means of the X-Y drive system with respect to the front panel that has been preliminarily secured onto a planar stage by vacuum suction or the like. It is desirable that the scan pitch of the thermal plasma torch (50) is smaller than the inner diameter of a nozzle of the thermal plasma torch (i.e. inner diameter of the surrounding electrode's hole that is opposed to the substrate), so that the whole of the protective layer (16) is heated uniformly. The scanning speed of the thermal plasma torch (50) is in the range of from about 100 mm/s to about 5000 mm/s, preferably from about 200 mm/s to about 2000 mm/s, and more preferably from about 500 mm/s to about 1500 mm/s.

Figure 7:
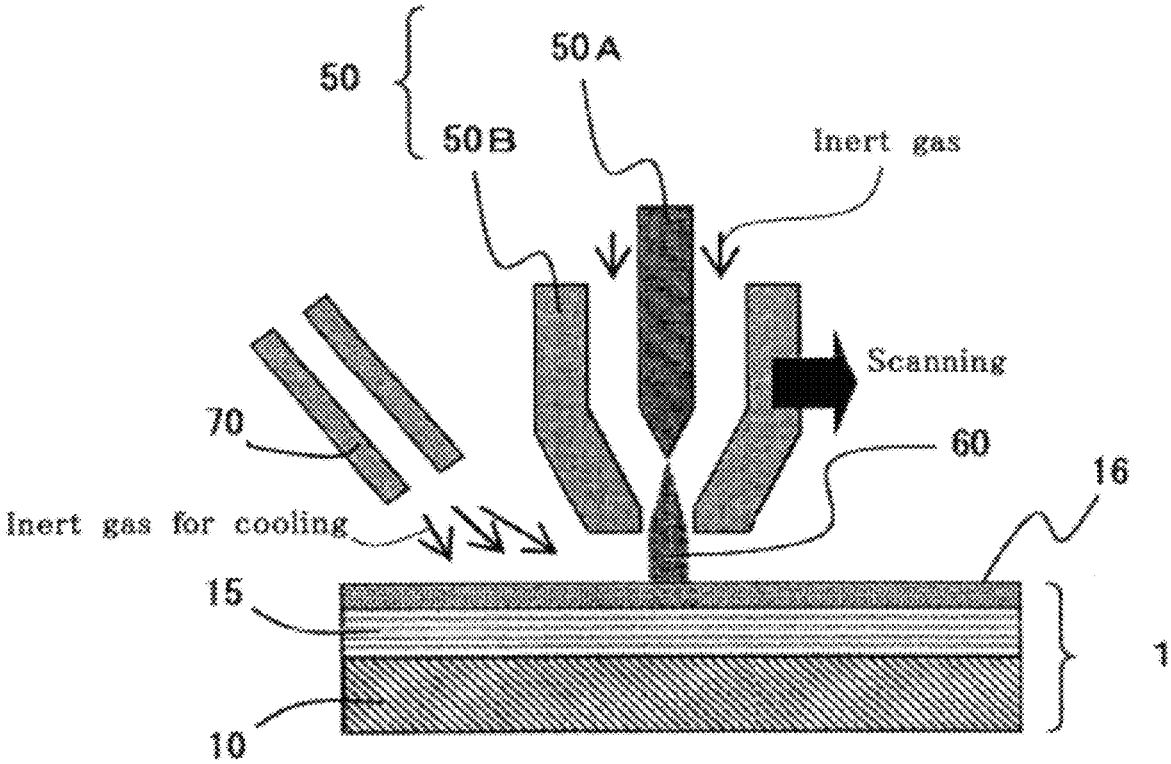
FIG. 7 is a sectional view schematically showing a concept of the present invention when an irradiation with thermal plasma is performed by means of a thermal plasma torch.

As the thermal plasma torch (50), a torch composed of a center electrode (50A) and a surrounding electrode (50B) as shown in FIG. 7 may be used, for example. The center electrode (50A) and the surrounding electrode (50B) are in a concentric arrangement and the cross sections thereof are in a form of round. The thermal plasma (60) is generated by forcing an inert gas to flow between the center electrode (50A) and the surrounding electrode (50B), and applying a high DC voltage across the center electrode (50A) and the surrounding electrode (50B). The thermal plasma can be generated under atmospheric pressure. Upon the heating of the protective layer (16), the protective layer is irradiated with the thermal plasma (60) generated from the thermal plasma torch, and a thermally non-equilibrium is achieved through the scanning of the torch at a speed as high as about 100 mm/s to 5000 mm/s so that only the protective layer (16) can be selectively heated. According to the present invention, the glass substrate (10) and the dielectric layer (15) of the front panel (1) are not cracked or deformed since they would never be heated as high as the protective layer (16) would be. Also use of the thermal plasma torch enables it to heat the protective layer (16) to a high temperature in a very short period of time, and thus the number of facilities required for the PDP production can decrease. Moreover, use of the thermal plasma torch enables it to decrease the energy required for the PDP production, which leads to a lower cost of the process.

Figure 8:
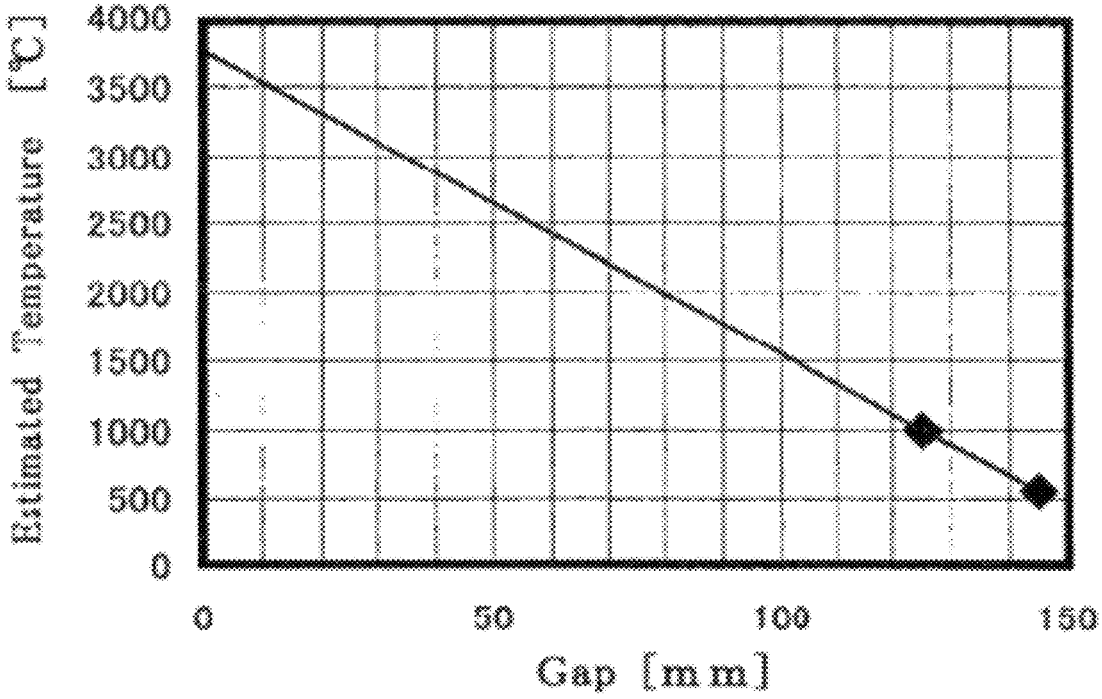
FIG. 8 is a graph showing a correlation between "distance between a thermal plasma torch and a protective layer surface" and "temperature of the protective layer surface".

The heating temperature in a case of the thermal plasma torch can be controlled by adjusting the distance between the thermal plasma torch (50) and the front panel (1), scanning speed and/or the value of DC voltage. For example, a higher heating temperature is achieved when the distance (gap) between the thermal plasma torch and the protective layer surface is smaller, the scanning speed of the thermal plasma torch is slower and/or the value of the DC voltage is higher. In general, there is such a correlation as shown in FIG. 8 between "distance (gap) between thermal plasma torch and protective layer surface" and "temperature of protective layer surface".

According to the method of the present invention, it is preferable to heat the protective layer while exposing it to an inert gas. As the inert gas, it is preferable to use at least one kind of gas selected from the group consisting of Ar (argon), $N_2$ (nitrogen), Ne (neon) and Xe (xenon), in which case a temperature of the inert gas may be in the range of from about 15° C. to about 35° C. Upon the thermal plasma heating, the surface of the protective layer may be irradiated with the thermal plasma while supplying inert gas to the surface of the protective layer. When a thermal plasma torch is used, a thermal plasma may be generated by applying a voltage across the center electrode and the surrounding electrode disposed in concentric configuration, while supplying an inert gas to the thermal plasma torch.

According to the method of the present invention, the protective layer after being heated may be forcibly cooled down although it possible to allow the protective layer to be spontaneously cooled down. It is preferred in this case that the protective layer is forced to be cooled down to 100° C. or lower by means of an inert gas. More specifically, it is preferable to cool down the protective layer, which has been heated to a temperature ranging from 1600° C. to 3600° C., to a room temperature of 100° C. or lower (e.g. about 25° C.) by using at least one kind of gas selected from the group consisting of Ar (argon), $N_2$ (nitrogen), Ne (neon) and Xe (xenon). The temperature of the inert gas to be used for cooling may be in the range of from about 15° C. to about 35° C., for example a room temperature (e.g. about 25° C.). The cooling of the protective layer by the inert gas may be performed as follows:

The protective layer is heated in a vessel filled with the inert gas.

In a case where the thermal plasma torch is used, the inert gas is blown to a portion of the protective layer surface over which the torch has passed (see FIG. 5).

The cooling of the protective layer can more effectively suppress the reaction between the impurities and the protective layer that has been heated. In other words, the protective layer after being heated can be effectively prevented from turning into hydroxide or carbonate in the course of the cooling down thereof. While the protective layer after being heated is more likely to turn into hydroxide or carbonate than that of normal temperature upon exposed to $H_2O$ and $CO_2$, such an undesirable formation of the hydroxide or carbonate can be avoided by cooling down the heated protective layer to 100° C. or lower in an inert gas.

Figure 9:
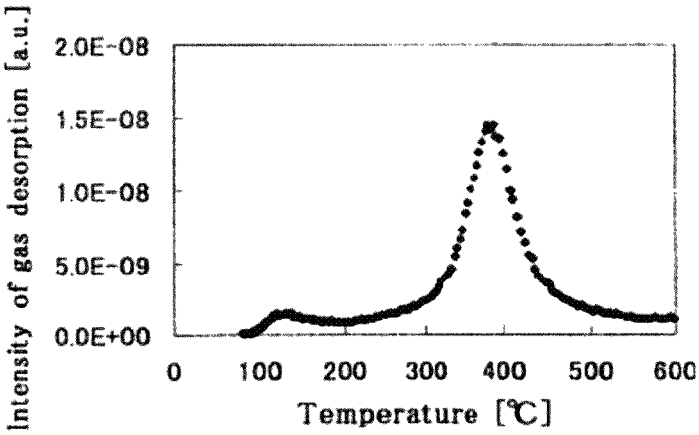
FIG. 9 is a graph showing a gas desorption characteristic of a protective layer after being subjected to a heat treatment at 1550° C.
Figure 9:
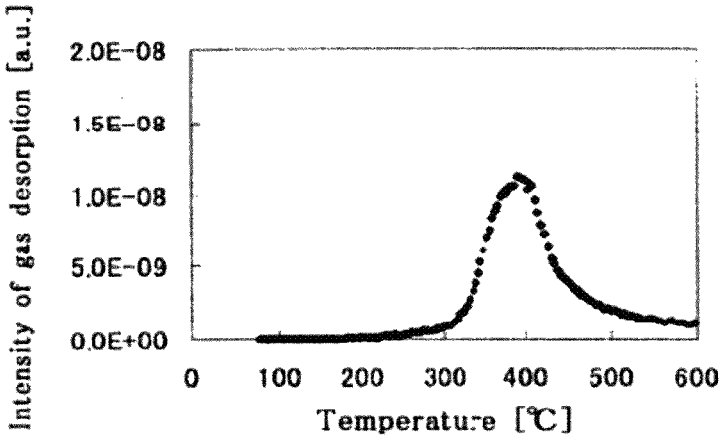
Figure 10:
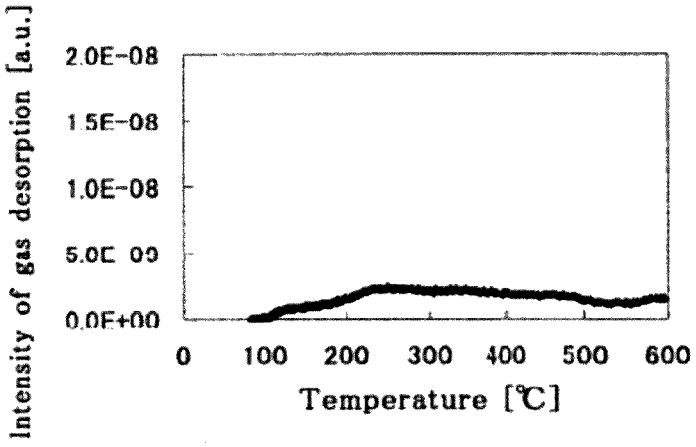
FIG. 10 is a graph showing a gas desorption characteristic of a protective layer after being subjected to a heat treatment at 2000° C.
Figure 10:
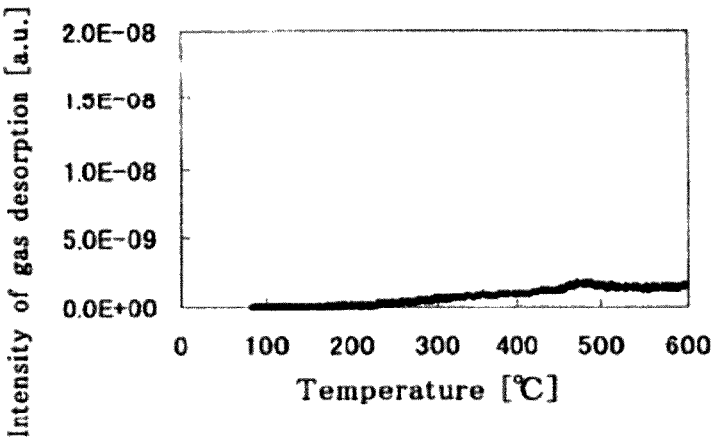

Now, the effects of the present invention will be described in detail below. FIG. 9 is a graph showing the gas desorption characteristic of the protective layer after being subjected to the heat treatment at 1550° C. FIG. 10 is a graph showing the gas desorption characteristic of the protective layer after being subjected to the heat treatment at 2000° C. More specifically, FIGS. 9 and 10 show the results of measuring the quantity of the gas released from the protective layer at the point in time after the heat treatment thereof, by means of a thermal desorption spectroscopy (TDS). FIG. 9(*i*) and FIG. 10(*i*) respectively show the desorption characteristic of molecule having mass number 18, namely $H_2O$. While on the other hand, FIG. 9(*ii*) and FIG. 10(*ii*) respectively show the desorption characteristic of molecule having mass number 44, namely $CO_2$.

As can be seen from FIGS. 9 and 10, $H_2O$ and $CO_2$ were observed to be released from the protective layer that has been heated to 1550° C. (particularly there is a strong peak of desorption at a temperature of 300° C. or higher). While on the other hand, only small amounts of $H_2O$ and $CO_2$ were respectively observed to be released from the protective layer that has been heated to 2000° C. (Namely, there is no strong peak of desorption in the case of 2000° C.). This means that the heating temperature of more than 1550° C. (e.g. from about 1600° C. to about 2000° C.) can not only achieve the removal of the impurities such as $H_2O$ and $CO_2$ from the protective layer, but also achieve the subsequent suppression of the reaction between the protective layer and the impurities such as $H_2O$ and $CO_2$.

It can be therefore understood that lower limit of the heating temperature of the protective layer can be 1600° C., and preferably 2000° C. according to the present invention.

Figure 11:
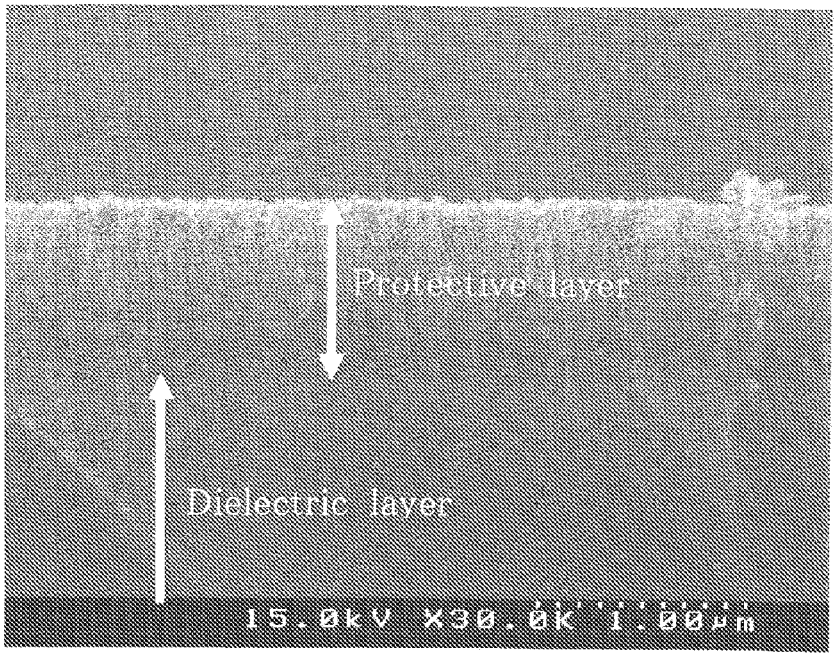
FIG. 11 is an electron microscope photograph of a part of a cross section of the front panel after being subjected to a heat treatment at 2800° C.
Figure 12:
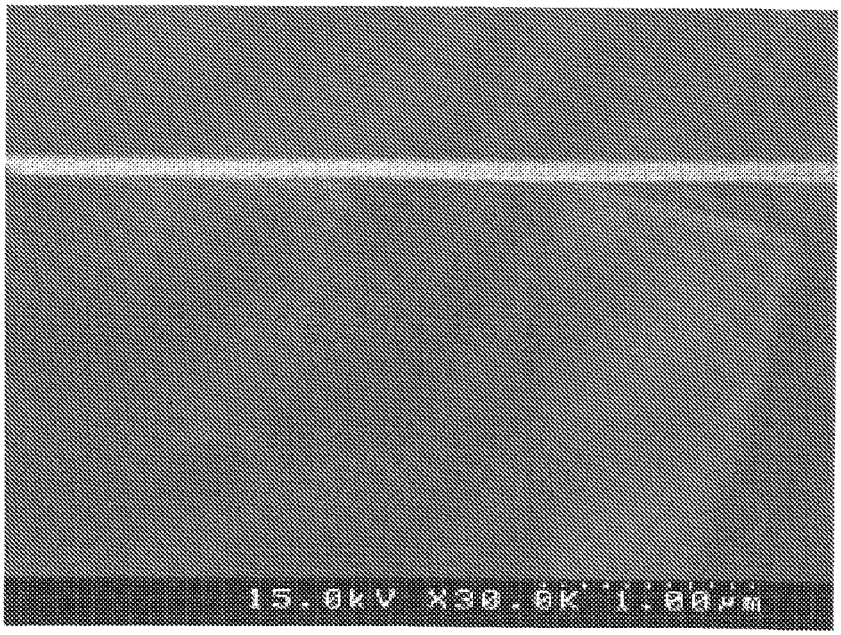
FIG. 12 is an electron microscope photograph of a part of a cross section of a front panel after being subjected to a heat treatment at 3700° C.

Now, the upper limit regarding the heating temperature of the protective layer will be described. FIG. 11 is an electron microscope photograph of a part of a cross section of the front panel after the heat treatment of the protective layer at 2800° C. FIG. 12 is an electron microscope photograph of a part of a cross section of the front panel after the heat treatment of the protective layer at 3700° C. As can be seen from the electron microscope photographs, a clear boundary was maintained between the protective layer and the dielectric layer in the case of the heat treatment of 2800° C., while on the other hand the boundary was blurred between the protective layer and the dielectric layer in the case of the heat treatment of 3700° C.

When the heating temperature of the protective layer is too high (for example, when the heating temperature is higher than about 3600° C.), the protective layer and the dielectric layer are melted and mixed with each other, thus making it impossible for the protective layer to have a high secondary electron emission characteristic which it naturally should have.

It can be therefore understood that the upper limit regarding the heating temperature of the protective layer can be 3600° C. according to the present invention.

As described above, the method of the present invention enables it not only to remove impurities (i.e. $H_2O$ and $CO_2$) of the protective layer therefrom but also to thereafter suppress the protective layer and the impurities (i.e. $H_2O$ and $CO_2$) from reacting with each other. In particular, the present invention has an outstanding effect of effectively suppressing the impurity gas from being adsorbed in spite of the fact that the protective layer is once exposed to the atmosphere after the heat treatment. This may be explained as follows, while not wishing to be bound by any theory (in a case of the protective layer made of MgO):

In the PDP front panel, the protective layer is generally formed from densely aggregated MgO poly-crystal MgO, although there can be minute voids between crystal grains of the MgO when viewed microscopically. Before the heat treatment of the protective layer, $H_2O$ molecules and/or $CO_2$ molecules are trapped and absorbed or adsorbed in the voids. When the protective layer is heated to a very high temperature in a range of from 1600° C. to 3600° C., there becomes no more void between the crystal grains of MgO. This means that there is occurred no space for $H_2O$ molecules and/or $CO_2$ molecules to be absorbed or adsorbed, and therefore the reaction between the protective layer and the impurity gas is suppressed thereafter.

The method of the present invention can promote the use of some favorable component (e.g. oxides of alkaline earth element) for the protective layer, which component tends to absorb or adsorb impurities, but is favorable in terms of "electric discharge characteristic" and "lower operating voltage". More specifically, the method of the present invention can promote the use of at least one kind of oxide selected from among magnesium oxide, calcium oxide, strontium oxide and barium oxide as the component of the protective layer. In particular, it can promote the use of the metal oxide consisting of at least two oxides selected from among magnesium oxide, calcium oxide, strontium oxide and barium oxide, said metal oxide having a peak diffraction angle between the minimum diffraction angle and the maximum diffraction angle which are selected among the diffraction angles given by respective ones of said at least two oxides constituting the metal oxide with respect to a specific orientation plane in X-ray diffraction analysis.

In a case where the metal oxide of the protective layer consists of at least two oxides selected from among magnesium oxide, calcium oxide, strontium oxide and barium oxide, the electric discharge starting voltage of the panel can be lowered and the delay in electric discharge can be decreased, which leads to an achievement of a stable electric discharge of the PDP. However, the above metal oxide of the protective layer is highly reactive with impurity gases such as water and carbon dioxide. Namely, the above metal oxide of the protective layer may easily react with water and carbon dioxide. This means that the electric discharge characteristic may be deteriorated in the case of the above metal oxide of the protective layer, thus resulting in a variation in the electric discharge characteristic among the discharge cells. The inventors of the present application have found through researches that the adsorption of the impurity gases can be suppressed or decreased by performing a heat treatment of the protective layer before the sealing process such that the protective layer reaches a high temperature of above 1600° C. It should be noted that the glass substrate used in PDP has a resistance to high temperature of about 600° C. and lower, and therefore a calcining process is conducted usually at a temperature of 600° C. or lower. In this regard, a significant improvement as to the decreased adsorption of the impurity gas could not be achieved by subjecting the protective layer to the heat treatment at 600° C.

The present invention makes it possible to produce the PDP that has a high brightness display capability and can be operated at a lower voltage. There is almost no moisture and gas (e.g. carbon dioxide) within the PDP panels, such moisture and gas causing a denaturing or deterioration of the protective layer surface or phosphor layer surface. Consequently, the protective layer and the phosphor layer are hardly denatured, which leads to a longer panel service life of the PDP with a less variability in brightness and a lower discharge voltage.

(Protective Layer Formed According to the Present Invention)

The component of the protective layer, which can be preferably used according to the present invention, will be described in detail below. The protective layer (16) is preferably composed of a base film (16*a*) and aggregated particles (16*b*'), as shown in FIG. 2(*b*). The base film is formed on the dielectric layer (15). The aggregated particles (16*b*'), which consist of a plurality of crystal particles (16*b*) of magnesium oxide (MgO), are disposed on the base film (16*a*). As for the base film (16*a*), it is preferably made of at least one metal oxide selected from among magnesium oxide (MgO), calcium oxide (CaO), strontium oxide (SrO) and barium oxide (BaO). More specifically, according to the present invention, the base film (16*a*) of the protective layer (16) is preferably made of a metal oxide consisting of at least two oxides selected from among magnesium oxide (MgO), calcium oxide (CaO), strontium oxide (SrO) and barium oxide (BaO).

The base film (16*a*) may be formed by a thin film process using pellets of a oxide selected from among magnesium oxide (MgO), calcium oxide (CaO), strontium oxide (SrO) and barium oxide (BaO), or pellets prepared by mixing these oxides. As the thin film process, a known process such as an electron beam vapor deposition process, a sputtering process or an ion plating process may be used. The upper limit of pressure that can be practically used is about 1 Pa for the sputtering process, and about 0.2 Pa for the electron beam vapor deposition process (that is an example of vapor deposition processes). With regard to the atmosphere for the forming of the base film (16*a*), it is preferable to carry out the thin film process in a closed condition being isolated from the outside, in order to prevent the contact with the moisture and the adsorption of the impurities. By controlling the atmosphere in which the base film is formed, the base film (16*a*) made of the metal oxide with a desired electron releasing characteristic is obtained.

The aggregated particles (16*b*'), which are composed of the crystal particles (16*b*) made of magnesium oxide (MgO) on the base film (16*a*), will be described below. The crystal particles (16*b*) can be produced by a gas phase synthesis process or a precursor calcining process. In the gas phase synthesis process, magnesium with purity of 99.9% or higher is heated in an inert gas atmosphere, and then a small amount of oxygen is introduced into the atmosphere. As a result, the magnesium is directly oxidized to form the crystal particles (16*b*) of magnesium oxide (MgO).

In the precursor calcining process, a precursor of magnesium oxide (MgO) is uniformly heated at a temperature as high as about 700° C. or higher, and is then gradually cooled down to produce the crystal particles (16*b*) of magnesium oxide (MgO). The precursor may be one or more kinds of compound selected from among magnesium alkoxide ($Mg(OR)_2$), magnesium acetylacetone ($Mg(acac)_2$), magnesium hydroxide ($Mg(OH)_2$), magnesium carbonate ($MgCO_2$), magnesium chloride ($MgCl_2$), magnesium sulfate ($MgSO_4$), magnesium nitrate ($Mg(NO_3)_2$) and magnesium oxalate ($MgC_2O_4$). Some of these compounds may be in the form of hydrate, and in this regard such hydrate can be used in the present invention. The above compound is prepared so as to produce magnesium oxide (MgO) with purity of 99.95% or higher and preferably 99.98% or higher after being calcined. In a case where the compound contains alkaline metal or elements such as B, Si, Fe or Al as impurities with a concentration thereof higher than a certain level, an undesired fusing of particles or sintering may occur during the heat treatment, and thereby inhibiting a production of crystal particles of magnesium oxide (MgO) with high crystallinity. For this reason, it is necessary to take measures such as removing impurity elements from the precursor.

The crystal particles (16*b*) of magnesium oxide (MgO) produced by any one of the processed described above are dispersed into a solvent, and the resulting dispersion liquid is spread over the surface of the base film (16*a*) by spraying process, screen printing process, slit coating process, electrostatic application process or the like. Thereafter the solvent of the dispersion liquid is removed by drying process, followed by a calcining process. As a result, the crystal particles (16*b*) of magnesium oxide (MgO) are fixed or secured on the surface of the base film (16*a*).

The process of distributing and fixing the crystal particles (16*b*) of magnesium oxide (MgO) onto the surface of the base film (16*a*) is preferably performed at a low temperature of about 400° C. or lower, in order to suppress a reaction of the base film (16*a*) with impurities.

Furthermore, the protective layer, which may characterize the present invention, will be described in much more detail. According to the method of the present invention, the protective layer of the front panel is formed from a metal oxide consisting of at least two oxides selected from among magnesium oxide, calcium oxide, strontium oxide and barium oxide, said metal oxide having a peak diffraction angle between the minimum diffraction angle and the maximum diffraction angle which are selected among the diffraction angles given by respective ones of said oxides (more specifically respective ones of the metal oxides constituting the above metal oxide of the protective layer) with respect to some orientation plane in X-ray diffraction analysis. In this regard, it is preferable to form the base film (16*a*) of the protective layer from such metal oxide. In other words, the base film (16*a*) of the protective layer is formed from a metal oxide consisting of at least two oxides selected from among magnesium oxide(MgO), calcium oxide(CaO), strontium oxide(SrO) and barium oxide(BaO), said metal oxide having a peak diffraction angle between the minimum diffraction angle and the maximum diffraction angle which are selected among the diffraction angles given by respective ones of said oxides (more specifically respective ones of the metal oxides constituting the above metal oxide of the base film (16*a*)) with respect to a specific orientation plane in X-ray diffraction analysis.

Figure 13:
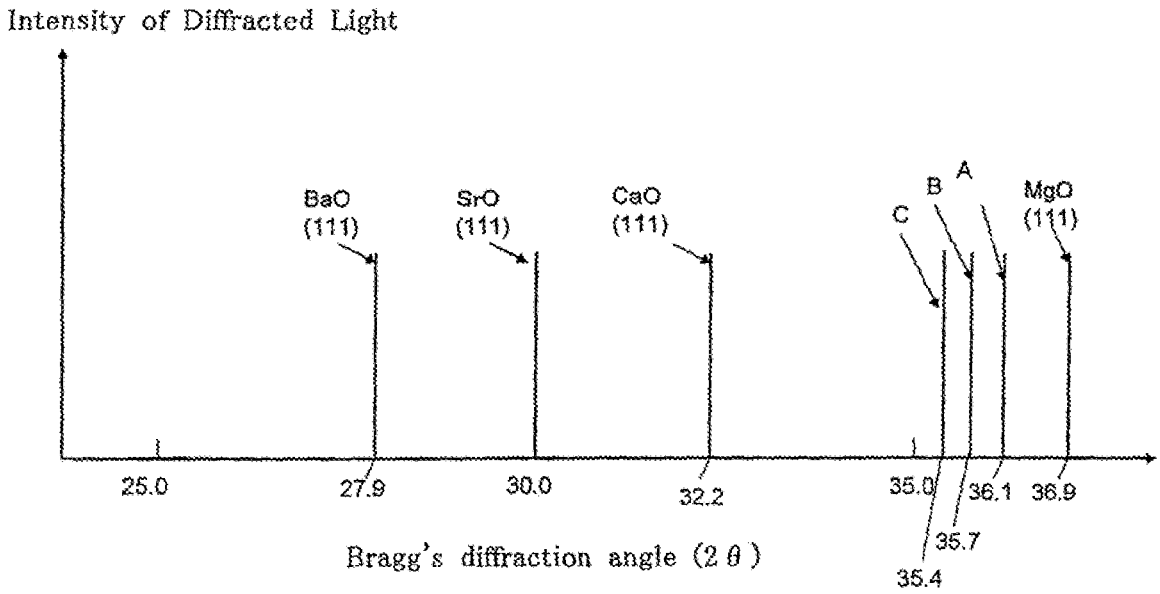
FIG. 13 is a diagram showing the result of X-ray diffraction analysis with respect to the base film of the PDP protective layer.

FIG. 13 is a diagram showing the result of X-ray diffraction analysis on the base film (16*a*) constituting the protective layer (16) of the PDP according to the embodiment of the present invention. FIG. 13 also shows the results of X-ray diffraction analysis conducted separately on magnesium oxide (MgO), calcium oxide (CaO), strontium oxide (SrO) and barium oxide (BaO).

In FIG. 13, Bragg's diffraction angle (2θ) is plotted along the horizontal axis and X-ray diffraction intensity is plotted along the vertical axis. The diffraction angle is shown by the unit of degrees, with 360 degrees meaning one full turn. The diffraction intensity is shown with arbitrary unit. In the diagram, a crystal orientation plane, which corresponds to specific orientation planes, is indicated in parentheses. As shown in FIG. 13, it can be seen that, with respect to the crystal orientation (111), calcium oxide (CaO) has a diffraction angle of 32.2 degrees, magnesium oxide (MgO) has a diffraction angle of 36.9 degrees, strontium oxide (SrO) has a diffraction angle of 30.0 degrees and barium oxide (BaO) has a diffraction angle of 27.9 degrees as a peak diffraction angle.

FIG. 13 also shows the result of X-ray diffraction analysis in a case of the base film (16*a*) made of a metal oxide consisting of the two oxides selected from magnesium oxide (MgO), calcium oxide (CaO), strontium oxide (SrO) and barium oxide (BaO). In FIG. 13, the result of X-ray diffraction analysis of the base film (16*a*) formed from magnesium oxide (MgO) and calcium oxide (CaO) is shown as "A", the result of X-ray diffraction analysis of the base film (16*a*) formed from magnesium oxide (MgO) and strontium oxide (SrO) is shown as "B", and result of X-ray diffraction analysis of the base film (16*a*) formed from magnesium oxide (MgO) and barium oxide (BaO) is shown as "C".

As will be seen from the result of X-ray diffraction analysis shown in FIG. 13, the point A represents a peak at diffraction angle of 36.1 degrees between the diffraction angle of 36.9 degrees of magnesium oxide (MgO) that is the maximum diffraction angle among the individual oxides and the diffraction angle of 32.2 degrees of calcium oxide (CaO) that is the minimum diffraction angle among the individual oxides with respect to the crystal orientation plane (111) that is the specific orientation plane. Similarly, the point B and point C represent peaks at diffraction angles of 35.7 degrees and 35.4 degrees, respectively, between the maximum diffraction angle and the minimum diffraction angle among the individual oxides with respect to the crystal orientation plane (111).

Figure 14:
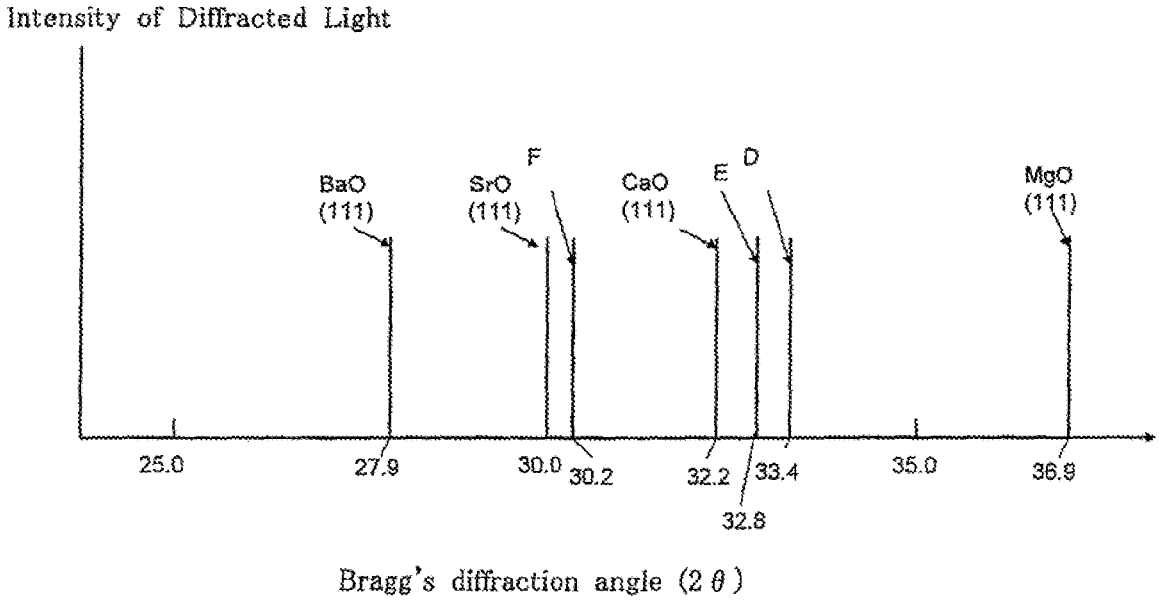
FIG. 14 is a diagram showing the result of X-ray diffraction analysis with respect to the base film of the PDP protective layer (another component).

Similarly to FIG. 13, FIG. 14 shows the results of X-ray diffraction analysis in a case of the base film (16*a*) made of a metal oxide consisting of the three or more oxides selected from magnesium oxide (MgO), calcium oxide (CaO), strontium oxide (SrO) and barium oxide (BaO). In FIG. 14, the result of X-ray diffraction analysis of the base film (16*a*) formed from magnesium oxide (MgO), calcium oxide (CaO) and strontium oxide (SrO) is shown as "D", the result of X-ray diffraction analysis of the base film (16*a*) formed from magnesium oxide (MgO), calcium oxide (CaO) and barium oxide (BaO) is shown as "E", and the result of X-ray diffraction analysis of the base film (16*a*) formed from calcium oxide (CaO), strontium oxide (SrO) and barium oxide (BaO) is shown as "F".

As will be seen from the results of X-ray diffraction analysis shown, point D represents a peak at a diffraction angle of 33.4 degrees between the diffraction angle of 36.9 degrees of magnesium oxide (MgO) that is the maximum diffraction angle among the individual oxides and the diffraction angle of 30.0 degrees of strontium oxide (SrO) that is the minimum diffraction angle with respect to the crystal orientation plane (111) that is the specific orientation plane. Similarly, point E and point F represent peaks at diffraction angles of 32.8 degrees and 30.2 degrees, respectively, between the maximum diffraction angle and the minimum diffraction angle among the individual oxides with respect to the crystal orientation plane (111).

As can be seen from above, the base film (16*a*) of the PDP protective layer of the present invention, regardless of whether it is formed from a metal oxide consisting of two or three individual oxides, has a peak diffraction angle between the minimum diffraction angle and the maximum diffraction angle which are selected among the diffraction angles given by respective ones of the metal oxides constituting the above metal oxide of the base film (16*a*) in a specific orientation plane in X-ray diffraction analysis.

While the crystal orientation plane (111) has been dealt with as the specific orientation plane in the above description, peak position of the metal oxide is similar to those described above also in a case where another crystal orientation plane is dealt with.

Calcium oxide (CaO), strontium oxide (SrO) and barium oxide (BaO) have depths with respect to the vacuum level in a shallow region compared to that of magnesium oxide (MgO). As a result, when electrons existing in the energy levels of calcium oxide (CaO), strontium oxide (SrO) and barium oxide (BaO) undergo transition to the base level of xenon (Xe) ion, it is expected that the number of electrons released by the Auger effect becomes larger than that of a case of transition from the energy level of magnesium oxide (MgO).

A metal oxide having the feature shown in FIG. 13 and FIG. 14 with regard to the result of X-ray diffraction analysis has energy level between those of the individual oxides that constitute them. As a result, the energy level of the base film (16*a*) also lies between those of the individual oxides, and is sufficient for the other electrons to acquire the energy enough to exceed the vacuum level and be released by the Auger effect.

Thus, the base film (16*a*) provides better secondary electron emission characteristic compared to the case of individual magnesium oxide (MgO), so that electric discharge sustaining voltage can be decreased. This means that the discharge voltage can be decreased and the PDP operating at a low voltage with high brightness can be realized when the partial pressure of xenon (Xe) used as the discharge gas is increased for increasing the brightness.

The electric discharge sustaining voltage of the PDP obtained with the method of the present invention when the constitution of the base film (16*a*) is altered will be described below. A sample A (the base film is formed from magnesium oxide and calcium oxide as the metal oxide), a sample B (the base film is formed from magnesium oxide and strontium oxide as the metal oxide), a sample C (the base film is formed from magnesium oxide and barium oxide as the metal oxide), a sample D (the base film is formed from magnesium oxide, calcium oxide and strontium oxide as the metal oxide) and a sample E (the base film is formed from magnesium oxide, calcium oxide and barium oxide as the metal oxide) were prepared as the sample of the present invention. A comparative example was prepared by forming the base film from magnesium oxide.

The electric discharge sustaining voltage measured on samples A to E was 90 for the sample A, 87 for the sample B, 85 for the sample C, 81 for the sample D and 82 for the sample E, relative to the value of the comparative example that was assumed to be 100.

Increasing the partial pressure of xenon (Xe) as the discharge gas from 10% to 15% causes brightness to increase by about 30%, while causing the electric discharge sustaining voltage to increase by about 10% in the comparative example where the base film (16*a*) is formed from magnesium oxide (MgO) only. In the PDP obtained with the method of the present invention, in contrast, the electric discharge sustaining voltage can be decreased by about 10% to 20% in any of the sample A, sample B, sample C, sample D and sample E, compared to the comparative example, thus making it possible to keep the electric discharge starting voltage within the range of normal operation thereby to realize the PDP that is capable of achieving high brightness while operating at a low voltage.

Calcium oxide (CaO), strontium oxide (SrO) and barium oxide (BaO) have high reactivity individually and are apt to react with impurities leading to a decrease in the electron releasing performance, although use of these metal oxides lowers the reactivity and forms such crystal structure that is less prone to the inclusion of impurities and oxygen defects. That is, use of calcium oxide (CaO), strontium oxide (SrO) and barium oxide (BaO) in the form of metal oxide suppresses electrons from being released excessively during the operation of the PDP, so as to obtain reasonable effect of electron releasing characteristic in addition to the double effects of low voltage operation and secondary electron emission performance. The electric charge retaining performance is advantageous for ensuring reliable writing discharge by retaining wall electrons that have been accumulated during the initialization period and preventing writing failure from occurring during the writing period.

The aggregated particles (16*b*') composed of a plurality of crystal particles (16*b*) of magnesium oxide (MgO) deposited on the base film (16*a*) will be described in detail below. The aggregated particles (16*b*') of magnesium oxide (MgO) have proved to have the effect of suppressing the delay in discharge during writing discharge and the effect of improving the temperature dependency of the delay in electric discharge, in experiments conducted by the inventors of the present invention. Accordingly, in the present invention, the aggregated particles (16*b*') are disposed as the source of primary electrons that is required during the rise of the discharge pulse, by taking advantage of better primary electron releasing characteristic of the aggregated particles (16*b*') than that of the base film (16*a*).

"Delay in electric discharge" is considered to be caused mainly by the shortage in the number of primary electrons, which serve as the trigger at the start of electric discharge, released from the surface of the base film (16*a*) into the discharge space. Therefore, in order to stabilize the supply of primary electrons into the discharge space, the aggregated particles (16*b*') of magnesium oxide (MgO) are disposed in a dispersed manner over the surface of the base film (16*a*). This leads to the elimination of the delay in electric discharge, with abundant of electrons supplied in the discharge space during the rise of the discharge pulse. As a result, such a primary electron releasing characteristic enables it to operate the PDP at a high speed with good electric discharge response characteristic even during high definition display operation. The constitution wherein the aggregated particles (16*b*') of metal oxide are disposed on the surface of the base film (16*a*) achieves the effect of suppressing the "delay in electric discharge" during writing discharge and the effect of improving the temperature dependency of the "delay in electric discharge". Thus the PDP obtained with the method of the present invention is capable of operating at a high speed at a low voltage even during high definition display operation and achieving high quality picture display while suppressing lighting failure, by the protective layer composed of the base film (16*a*) that has the double effects of low voltage operation and electric charge retaining, and the aggregated particles (16*b*') of magnesium oxide (MgO) that have the effect of preventing the delay in electric discharge.

Figure 15:
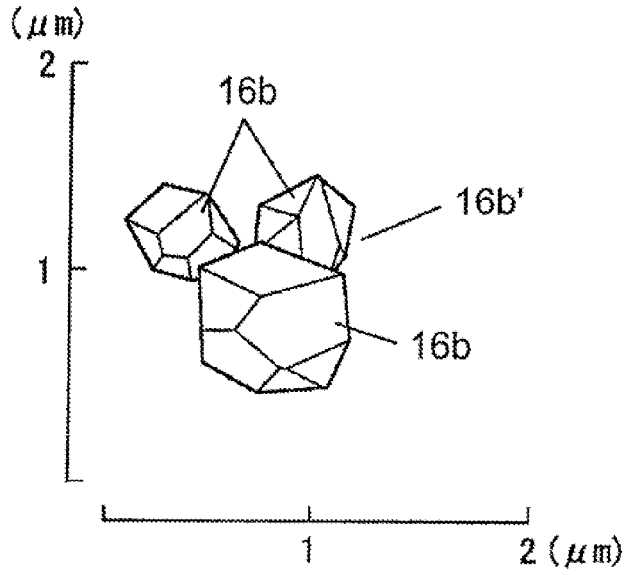
FIG. 15 is an enlarged diagram showing aggregated particles of the PDP protective layer.

In a preferred embodiment of the present invention, the aggregated particles (16*b*') composed of several crystal particles (16*b*) are dispersed on the base film (16*a*), so that a plurality of the aggregated particles are distributed so as to deposit substantially uniformly over the entire surface of the base film. FIG. 15 is an enlarged diagram showing the aggregated particles (16*b*').

As shown in FIG. 15, the aggregated particles (16*b*') are clusters of crystal particles (16*b*) with predetermined primary size that have been aggregated together. Thus the aggregated particles (16*b*') take the form of clusters of the primary particles aggregated by the electrostatic attraction or van der Waals forces, not by a strong bonding force as in a solid. Namely, the aggregated particles (16*b*') are bonded together such that a part or whole of them are allowed to dissociate to turn a form of the primary particles by an extraneous influence such as ultraviolet excitation. The size of the aggregated particles is preferably about 1 μm. And also the crystal particles preferably have polyhedral shape that has seven or more faces such as dodecahedron or quadridecahedron.

The particle size of the primary particles regarding the crystal particles (16*b*) can be controlled by the conditions of forming the crystal particles (16*b*). For example in a case where the crystal particles (16*b*) are formed by calcining an MgO precursor such as magnesium carbonate or magnesium hydroxide, the particle size can be controlled by adjusting the calcining temperature and calcining atmosphere. While the calcining temperature may be set within a range of from 700 to 1500° C., the setting the calcining temperature at a relatively high level of about 1000° C. or higher makes it possible to control the particle size to about 0.3 to 2 μm. Moreover, when the crystal particles (16*b*) are formed by heating an MgO precursor, the aggregated particles (16*b*') can be obtained as a plurality of the primary particles are aggregated together in the formation process.

Figure 16:
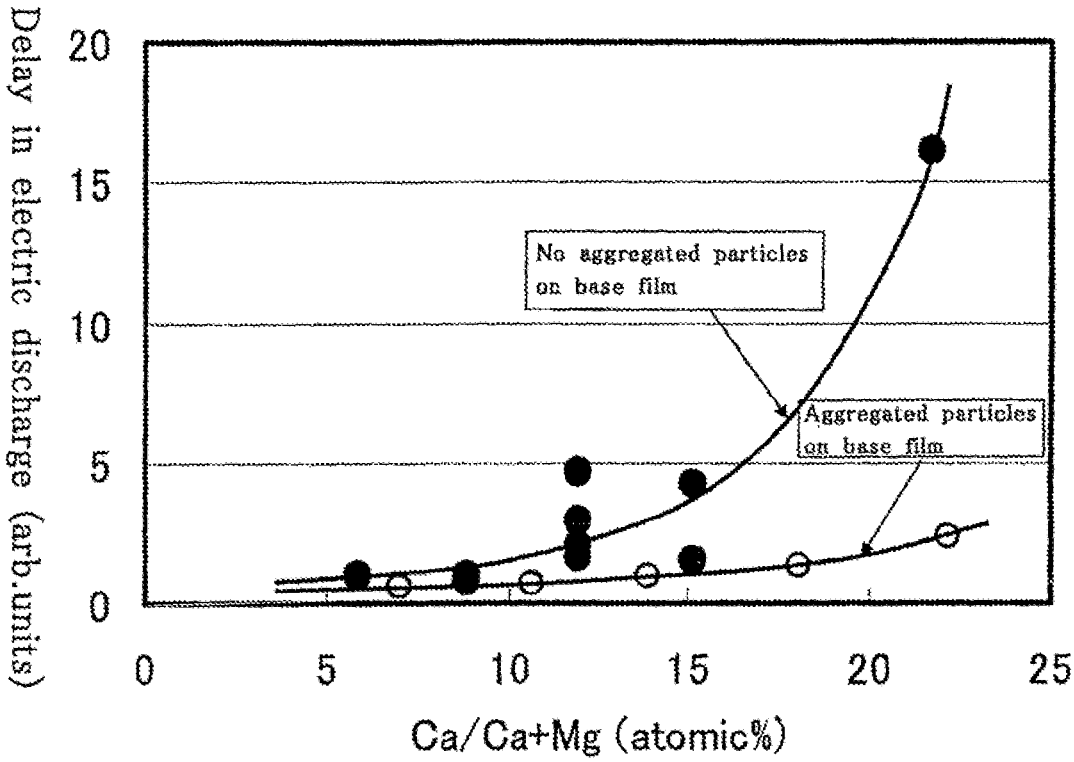
FIG. 16 is a diagram showing a relationship between the delay in electric discharge of PDP and calcium (Ca) concentration in the protective layer.

FIG. 16 shows the relationship between the delay in electric discharge and the calcium (Ca) concentration in the protective layer, in a case where the base film (16*a*) is formed from metal oxides of magnesium oxide (MgO) and calcium oxide (CaO) according to the embodiment of the present invention. The base film (16*a*) is formed from metal oxides of magnesium oxide (MgO) and calcium oxide (CaO), and the metal oxide is conditioned so that X-ray diffraction analysis on the surface of the base film (16*a*) shows a peak diffraction angle between the diffraction angle at which the peak of magnesium oxide (MgO) appears and the diffraction angle at which the peak of calcium oxide (CaO) appears. FIG. 16 shows a case where only the base film (16*a*) is provided as the protective layer, and a case a where the aggregated particles (16*b*') are disposed on the base film (16*a*), and the delay in discharge is shown with reference to a case where the base film (16*a*) does not contains the calcium oxide (Ca).

The electron releasing performance is an indicator of which value being higher indicates a larger number of released electrons, and is represented by the number of primary electrons released, which is determined by the surface condition and the type of gas. The number of primary electrons released can be determined by measuring the current of electrons released from the surface when the surface is irradiated with ion beam or electron beam, although it is difficult to evaluate the front panel surface of the PDP in non-destructive manner. Therefore, the method described in Japanese Patent Kokai Publication No. 2007-48733 was employed. Specifically, as the delay electric in charge, a value called the statistic delay period that indicates the aptness to electric discharge was measured, and the inverse of the value is integrated to give a value that corresponds to the number of primary electrons released and the line shape. This value is used in the evaluation. The delay in electric discharge refers to the time elapsed after the rising of the pulse till the electric discharge occurs. The delay in electric discharge is considered to be caused mainly by the difficulty of the primary electrons, which serve as the trigger at the start of discharge, to be released from the surface of the protective layer into the discharge space.

As is apparent from FIG. 16, the delay in electric discharge increases as the concentration of calcium (Ca) increases in the case where only the base film (16*a*) is provided. While on the other hand, the delay in electric discharge can be greatly decreased by disposing the aggregated particles (16*b*') on the base film (16*a*), so that the delay in electric discharge hardly increases even when the concentration of calcium (Ca) increases.

The results of experiment conducted to investigate the effects of the protective layer that has the aggregated particles (16*b*') according to the embodiment of the present invention will be described below. First, PDPs having the base film (16*a*) of different constitutions and the aggregated particles (16*b*') provided on the base film (16*a*) were fabricated as prototypes. Prototype 1 is a PDP having the protective layer (16) that consists of only the base film (16*a*) of magnesium oxide (MgO), prototype 2 is a PDP having the protective layer that consists of only the base film (16*a*) of magnesium oxide (MgO) doped with impurity such as Al, Si or the like, and prototype 3 is a PDP having the protective layer whereon primary particles of crystal particles (16*b*) of magnesium oxide (MgO) spread and deposited on the base film (16*a*) of magnesium oxide (MgO).

Prototype 4 includes a protective layer made of sample A described previously. That is, the protective layer comprises the base film (16*a*) formed from metal oxides of magnesium oxide (MgO) and calcium oxide (CaO), and aggregated particles (16*b*') composed of aggregated crystal particles (16*b*) deposited on the base film (16*a*) so as to be distributed substantially uniformly over the entire surface thereof. The base film (16*a*) is conditioned so as to show a peak diffraction angle between the minimum diffraction angle and the maximum diffraction angle of the peak observed in X-ray diffraction analysis of the oxide that constitutes the base film (16*a*). The minimum diffraction angle in this case is 32.2 degrees of calcium oxide (CaO) and maximum diffraction angle is 36.9 degrees of magnesium oxide (MgO), while the base film 91 shows a peak of diffraction at diffraction angle of 36.1 degrees.

Figure 17:
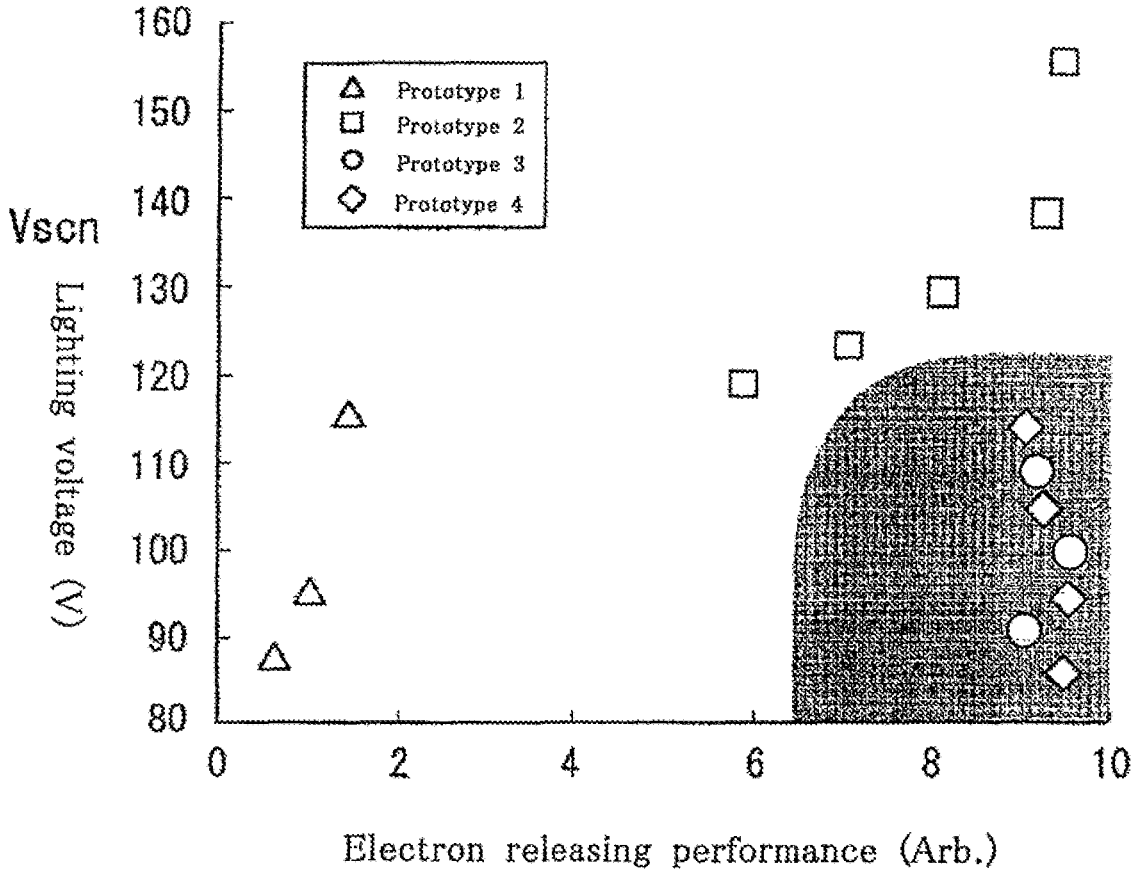
FIG. 17 is a diagram showing the outcomes of study as to the electron releasing performance and electric charge retaining performance of the PDP.

These PDPs were evaluated for the electron releasing performance and the electric charge retaining performance. The results are shown in FIG. 17. The electron releasing performance was evaluated by the method described previously, and the electric charge retaining performance was evaluated in terms of the voltage applied to the scan electrode (hereinafter referred to a Vscn lighting voltage) that is required for suppressing the release of electric charges when produced as the PDP. A lower Vscn lighting voltage means higher charge retaining capability. This means that components having lower withstanding voltage and/or lower capacity can be used for the power supply and electric components when designing the PDP. Currently commercialized products use semiconductor elements such as MOSFET that have withstanding voltage of about 150 V for applying the scan voltage to the panel, while it is desired to suppress the Vscn lighting voltage to about 120 V or lower in consideration of variation attributed to the temperature.

As can be seen from FIG. 17, in the case of prototype 4 that was made by spreading the aggregated particles (16*b*') formed from aggregated single crystal particles (16*b*) of magnesium oxide (MgO) deposited on the base film (16*a*) so as to distribute the aggregated particles (16*b*') substantially uniformly over the entire surface of the base film (16*a*), the Vscn lighting voltage can be controlled to 120 V or lower in the evaluation of the electric charge retaining performance and, in addition, far higher electron releasing characteristic can be achieved than that of prototype 1 of which protective layer was formed from magnesium oxide (MgO) only.

Electron releasing capability and charge retaining capability of the protective layer of the PDP are generally incompatible with each other. For example, electron releasing performance may be improved by changing the film forming conditions for the protective layer or doping the protective layer with impurity such as Al, Si or Ba, although it results in an increase in the Vscn lighting voltage as the side effect.

The PDP of prototype 4 shows the electron releasing performance 8 times higher than that of prototype 1 of which protective layer was formed from magnesium oxide (MgO) only, and achieves the charge retaining capability with Vscn lighting voltage of 120 V or lower. This is advantageous for the PDP that is designed with an increasing number of scan lines for higher definition display and smaller cell size, thus making it possible to meet the requirements of the electron releasing capability and the charge retaining capability at the same time and decrease the delay in electric discharge, thereby achieving higher quality pictures.

The particle size of the crystal particles (16*b*) will be described in detail below. In the description that follows, "particle size" means a mean particle size and the mean particle size means an accumulated volume mean particle size (D50).

Figure 18:
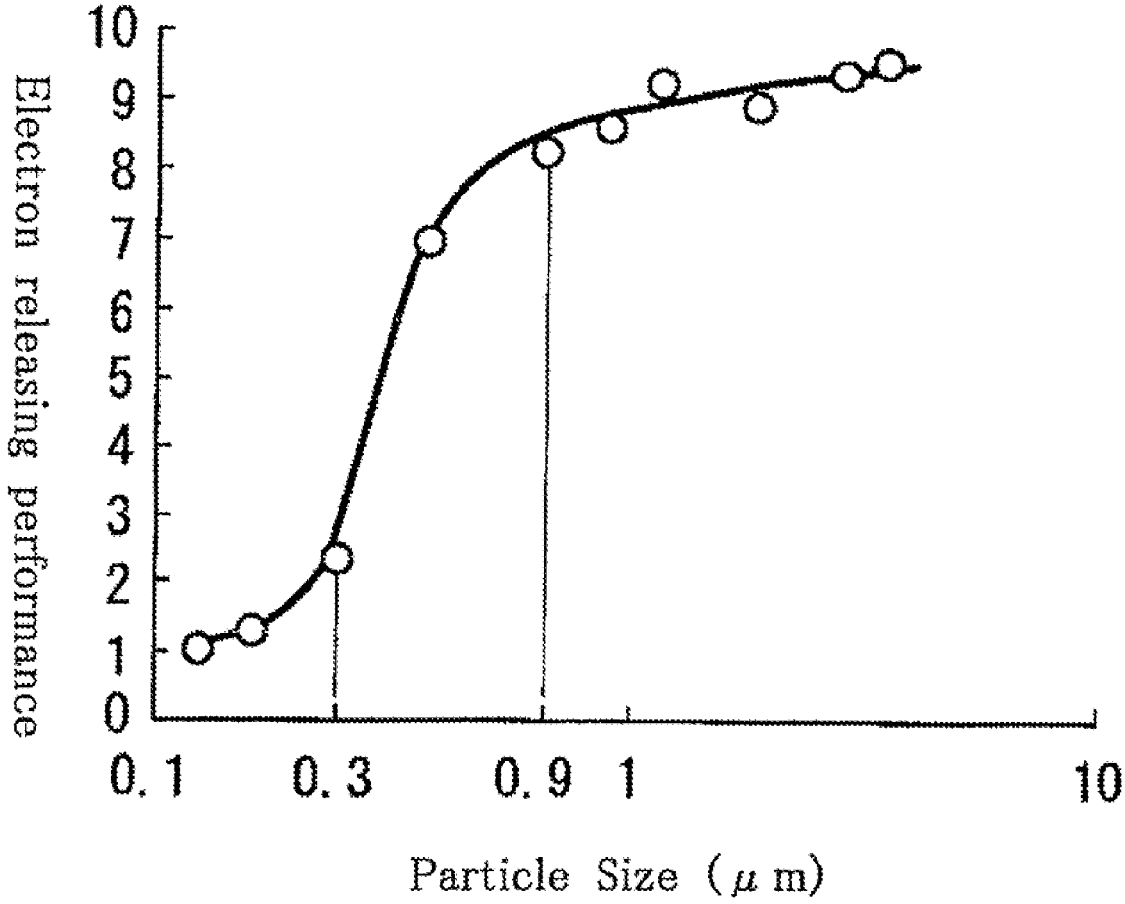
FIG. 18 is a diagram showing a relationship between the crystal particle size used in the PDP and the electron releasing characteristic.

FIG. 18 shows the results of experiment conducted to investigate the electron releasing performance of prototype 4 of the present invention shown in FIG. 17 by changing the particle size of the crystal particles (16*b*). The particle size of the crystal particles (16*b*) shown in FIG. 18 was measured by observing the crystal particles under SEM. As shown in FIG. 18, the small particle size of about 0.3 μm leads to the low electron releasing performance, while the particle size of about 0.9 μm or larger leads to the high electron releasing performance.

In order to increase the number of electrons released in the discharge cell, it is desirable that there are more crystal particles (16*b*) per unit area of the base film. According to the experiment conducted by the inventors of the present application, however, it was found that the crystal particles placed on a portion that corresponds to the top of the partition wall of the rear panel which makes contact with the protective layer of the front panel can damage the top of the partition wall, resulting in the broken chips falling onto the phosphor layer and making the cell unable to normally turn on and off. Since the damage on the top of the partition wall is unlikely to occur if there is no crystal particles (16*b*) on the top of the partition wall, probability of the partition wall to be damaged become higher when the number of crystal particles (16*b*) deposited increases. In line with these considerations, probability of the partition wall to be damaged sharply increases when the particle size of the crystal particles increases to about 2.5 μm, and probability of the partition wall can be kept relatively low when the particle size the of crystal particles is smaller than 2.5 μm.

As described above, it was found that the methods of the present invention can be stably achieved when the crystal particles (16*b*) with particle size in a range of from 0.9 μm to 2 μm are used in the protective layer. While the case of using the crystal particles (16*b*) of magnesium oxide (MgO) has been described above, similar effects can be achieved also by using other crystal particles of oxides of metals such as Sr, Ca, Ba and Al that have high electron releasing performance similarly to that of magnesium oxide (MgO). This means that the crystal particles are not limited to magnesium oxide (MgO).

Although a few embodiments of the present invention have been hereinbefore described, the present invention is not limited to these embodiments. It will be readily appreciated by those skilled in the art that various modifications are possible without departing from the scope of the present invention. For example, the following modifications are possible:

The dielectric layer formed on the front panel may also have two-layered structure composed of a first dielectric layer and a second dielectric layer. In this case, it is preferable that the first dielectric layer is formed from a dielectric material that contains 20 to 40% by weight of bismuth oxide ($Bi_2O_3$), 0.5 to 12% by weight of at least one kind selected from among calcium oxide (CaO), strontium oxide (SrO) and barium oxide (BaO) and 0.1 to 7% by weight of at least one kind selected from among molybdenum oxide ($MoO_3$), tungsten oxide ($WO_3$), cerium oxide ($CeO_2$) and manganese dioxide ($MnO_2$). Instead of molybdenum oxide ($MoO_3$), tungsten oxide ($WO_3$), cerium oxide ($CeO_2$) and manganese dioxide ($MnO_2$), 0.1 to 7% by weight of at least one kind selected from among copper oxide (CuO), chromium oxide ($Cr_2O_3$), cobalt oxide ($CO_2O_3$), vanadium oxide ($V_2O_7$) and antimony oxide ($Sb_2O_3$) may be contained. Also in addition to the components described above, such a composition that does not contain the element lead may be employed as 0 to 40% by weight of zinc oxide (ZnO), 0 to 35% by weight of boron oxide ($B_2O_3$), 0 to 15% by weight of silicon oxide ($SiO_2$) and 0 to 10% by weight of aluminum oxide ($Al_2O_3$). A paste material for the first dielectric layer having such a composition as described above is applied to the front-sided glass substrate by a die coating process or screen printing process so as to cover the display electrodes and then is dried, followed by calcining thereof at a temperature of from 575° C. to 590° C. that is a little higher than the softening point of the dielectric material, and thereby the first dielectric layer is finally formed.

The second dielectric layer is preferably formed from a material that contains 11 to 20% by weight of bismuth oxide ($Bi_2O_3$), 1.6 to 21% by weight of at least one kind selected from among calcium oxide (CaO), strontium oxide (SrO) and barium oxide (BaO) and 0.1 to 7% by weight of at least one kind selected from among molybdenum oxide ($MoO_3$), tungsten oxide ($WO_3$) and cerium oxide ($CeO_2$). Instead of molybdenum oxide ($MoO_3$), tungsten oxide ($WO_3$) and cerium oxide ($CeO_2$), 0.1 to 7% by weight of at least one kind selected from among copper oxide (CuO), chromium oxide ($Cr_2O_3$), cobalt oxide ($CO_2O_3$), vanadium oxide ($V_2O_7$), antimony oxide ($Sb_2O_3$) and manganese dioxide ($MnO_2$) may be contained. Also in addition to the components described above, such a composition that does not contain the element lead may be employed as 0 to 40% by weight of zinc oxide (ZnO), 0 to 35% by weight of boron oxide ($B_2O_3$), 0 to 15% by weight of silicon oxide ($SiO_2$) and 0 to 10% by weight of aluminum oxide ($Al_2O_3$). A paste for the second dielectric layer having such a composition as described above is applied to the first dielectric layer by the screen printing process or die coating process and then is dried, followed by calcining thereof at a temperature of from 550° C. to 590° C. that is a little higher than the softening point of the dielectric material, and thereby the second dielectric layer is finally formed. The PDP produced in this way is less likely to suffer from yellowing of the front glass substrate even when silver (Ag) is used in the display electrodes. Moreover, no gas bubble is generated in the dielectric layer, so that a high resistance to the dielectric breakdown phenomenon is achieved (namely, even when a high voltage is applied, there is occurred no "dielectric breakdown phenomenon" in the dielectric layer).

The case of the protective layer made of a metal oxide consisting of at least two oxides selected from among magnesium oxide, calcium oxide, strontium oxide and barium oxide has been described above. However, the present invention is not limited to such case. The present invention can also apply to another case of the protective layer made of a lanthanoid oxide such as lanthanum oxide or cerium oxide, as disclosed in Japanese Unexamined Patent Publication (Kokai) No. 2004-47193. Moreover, the present invention is not limited to the case of the protective layer formed by the electron beam deposition process. The present invention can also apply to another case of the protective layer which is formed by applying a paste including fine particles of metal oxide to the front panel followed by drying it.

According to the above description, the crystal particles of magnesium oxide (MgO) are fixed on the surface of the base film by spreading the crystal particles of magnesium oxide (MgO) dispersed in a solvent over the surface of the base film, followed by a drying and calcining processes thereof and the removal of the solvent therefrom. The protective layer thus produced is subjected to the heat treatment by means of the thermal plasma torch. However, the present invention is not limited to such embodiment. For example, the calcining process may be eliminated, and in this case it is possible to concurrently perform the fixation of the crystal particles of magnesium oxide (MgO) on the surface of the base film and an improvement step with respect to the adsorption of impurity gases onto the protective layer (particularly onto the base film) by using the thermal plasma torch. This means that a large calcining facility is not needed, and thus the energy consumed in production is reduced, which leads to an achievement of lower cost in the PDP production.

EXAMPLES

Test to Evaluate Gas Desorption Characteristic

Test was conducted to study the dependency of a gas desorption characteristic on the heating temperature of the protective layer. For this test, the front panel with the following specifications was used:

Component of the protective layer: Metal oxides comprising MgO and CaO
Thickness of protective layer: 0.8 μm
Component of dielectric layer: Low-melting point glass
Thickness of dielectric layer: 40 μm
Thickness of display electrode: 15 μm
Thickness/component of bus electrode: 6 μm/Ag
Thickness/component of transparent electrode: 100 nm/ITO
Substrate A: 1.8 mm-thick soda lime glass manufactured by Nippon Electric Glass Co., Ltd.

The protective layer of the above front panel was subjected to a heat treatment by scanning a thermal plasma torch under the following conditions (heating temperature of protective layer: about 2000° C.)

Distance (gap) between distal end of the nozzle of thermal plasma torch and front panel: 80 mm
Scanning pitch: 3 mm
Scanning speed: 1000 mm/s
Torch output power: 20 kW
Torch nozzle diameter: 40 mm The gas desorption characteristic of the protective layer was studied by applying a thermal desorption spectroscopy (TDS) to the front panel after being heated. As a result, a graph shown in FIG. 10 was obtained.

Cross-Sectional Observation of Front Panel

The cross section of the front panel was observed after the heat treatment thereof. Specifically, after applying a heat treatment to the front panel at "2800° C." and "3700° C." respectively, the cross sections of the front panel were photographed using an electron microscope. The results are shown in FIGS. 11 and 12. FIG. 11 is an electron microscope photograph showing a part of the cross section of the front panel that has undergone the heat treatment at 2800° C. While on the other hand, FIG. 12 is an electron microscope photograph showing a part of the cross section of the front panel that has undergone the heat treatment at 3700° C. As can be seen from the electron microscope photographs, the clear boundary was maintained between the protective layer and the dielectric layer in the case of the heat treatment at 2800° C., whereas the boundary was blurred between the protective layer and the dielectric layer in the case of the heat treatment at 3700° C.

Graph of FIG. 8

The following test was conducted to obtain the correlation between "temperature of protective layer surface" and "gap (i.e. distance between thermal plasma torch and front panel)" as shown in FIG. 8:

Two kinds of samples were respectively prepared by forming films of which denaturing could be visually recognized at 550° C. and 1000° C. on PDP glass substrates. As a sample film capable of denaturing at 550° C., a film formed by applying a dielectric material paste followed by drying it was used. This sample film can soften at 550° C. and thus a transition from white cloudy state to transparent state can be visually recognized. For another film capable of denaturing at 1000° C., an amorphous silicone film formed by plasma CVD process was used. This sample film can turn into poly-crystal at 1000° C. and thus a transition from brown to grey color can be visually recognized. The Two kinds of sample were processed while changing the gap in 10 mm step from 120 to 150 mm with the output power of the thermal plasma torch set to 20 kW and the scanning speed set to 1000 m/s. As a result, the film capable of denaturing at 550° C. did not denature when the gap was 150 mm, but denatured when the gap was 140 mm or less. The film capable of denaturing at 1000° C. did not denature when the gap was 130 mm or more, but denatured when the gap was 120 mm. From these results, it can be assumed that the surface temperature becomes 550° C. when the gap is 145 mm, and the surface temperature becomes 1000° C. when the gap is 125 mm. Assuming the linear relationship between the gap and the surface temperature, the graph as shown in FIG. 8 can be obtained.

Industrial Applicability

The PDP obtained by the method of the present invention has a satisfactory performance in terms of electric discharge characteristic and lower operating voltage, and thus it is not only suitable for household use and commercial use, but also suitable for use in other various kinds of display devices. The present invention is particularly advantageous for producing a PDP with a higher picture quality and a lower voltage driving.

CROSS REFERENCE TO RELATED PATENT APPLICATION

The disclosure of Japanese Patent Application No. 2009-195726 filed Aug. 26, 2009 including specification, drawings and claims is incorporated herein by reference in its entirety.

What is claimed is:

1. A method for producing a plasma display panel, the method comprising:

preparing a front panel and a rear panel, the front panel being a panel wherein a first electrode, a first dielectric layer and a protective layer are formed on a first substrate, and the rear panel being a panel wherein a second electrode, a second dielectric layer, a partition wall and a phosphor layer are formed on a second substrate;

opposing the front and rear panels with each other; and sealing peripheries of the front and rear panels with a sealing material, wherein an exposed surface of the protective layer is heated to a temperature ranging from 1600° C. to 3600° C. before the sealing of the peripheries of the front and rear panels.

2. The method according to claim 1, wherein the protective layer is heated by irradiating the surface thereof with a thermal plasma.

3. The method according to claim 1, wherein the protective layer is heated by a thermal plasma torch.

4. The method according to claim 1, wherein the protective layer is heated while being exposed to an inert gas.

5. The method according to claim 2, wherein the protective layer is heated by a thermal plasma torch; and wherein the thermal plasma is generated from the thermal plasma torch, while supplying an inert gas to the thermal plasma torch, by applying a voltage across a center electrode and a surrounding electrode of the thermal plasma torch, the center electrode and the surrounding electrode being in a concentric arrangement.

6. The method according to claim 1, wherein the first substrate is a glass substrate, and the protective layer is heated without melting the glass substrate.

7. The method according to claim 1, wherein the protective layer, after being heated, is cooled down to 100° C. or lower in an inert gas.

8. The method according to claim 1, wherein the protective layer to be heated is made from a metal oxide comprising at least two oxides selected from among magnesium oxide, calcium oxide, strontium oxide and barium oxide, the metal oxide having a peak between the minimum diffraction angle and the maximum diffraction angle which are selected among the diffraction angles given by respective ones of said at least two oxides in a specific orientation plane in X-ray diffraction analysis.

9. The method according to claim 1, wherein the exposed surface of the protective layer is heated to a temperature ranging from 2000° C. to 3600° C. before the sealing of the front and rear panels.

* * * * *